US005720279A

United States Patent [19]

Furuichi et al.

[11] Patent Number: 5,720,279

[45] Date of Patent: Feb. 24, 1998

[54] SEMICLOSED RESPIRATOR

[75] Inventors: Yutaka Furuichi, Tokyo; Shunsuke Matsuoka, Chiba-ken, both of Japan

[73] Assignee: Grand Bleu, Inc., Tokyo, Japan

[21] Appl. No.: 454,364

[22] PCT Filed: Jan. 10, 1994

[86] PCT No.: PCT/JP94/00021

§ 371 Date: Aug. 14, 1995

§ 102(e) Date: Aug. 14, 1995

[87] PCT Pub. No.: WO95/09762

PCT Pub. Date: Apr. 13, 1995

[30] Foreign Application Priority Data

Oct. 6, 1993 [JP] Japan ..... 5-274843

[51] Int. Cl.[6] ..... A62B 9/02

[52] U.S. Cl. ..... 128/204.26; 128/201.27; 128/201.28; 128/205.22; 128/205.28; 128/206.15

[58] Field of Search ..... 128/200.22, 200.29, 128/201.11, 201.26, 201.27, 201.28, 202.14, 203.24, 203.25, 204.18, 204.26, 205.12, 205.22, 205.28, 206.15, 206.29, 205.13, 205.21, 202.26

[56] References Cited

U.S. PATENT DOCUMENTS

| | | | |
|---|---|---|---|
| 819,704 | 5/1906 | Bamberger et al. | 128/202.26 |
| 2,732,840 | 1/1956 | Sanctis | 128/205.12 |
| 3,111,946 | 11/1963 | Galeazzi | 128/205.22 |
| 4,056,098 | 11/1977 | Michel et al. | 128/205.13 |
| 4,245,632 | 1/1981 | Houston | 128/201.11 |
| 4,365,628 | 12/1982 | Hodel | 128/205.21 |
| 4,964,404 | 10/1990 | Stone | 128/206.15 |
| 5,036,841 | 8/1991 | Hamilton | 128/205.28 |
| 5,127,398 | 7/1992 | Stone | 128/204.18 |
| 5,368,020 | 11/1994 | Beux | 128/205.28 |

FOREIGN PATENT DOCUMENTS

| | | | |
|---|---|---|---|
| 48-70400 | 9/1973 | Japan . | |
| 49-24114 | 6/1974 | Japan . | |
| 50-43920 | 12/1975 | Japan . | |
| 59-57090 | 4/1984 | Japan . | |
| 4-5196 | 1/1992 | Japan . | |
| 8103618 | 12/1981 | WIPO | 128/202.26 |

*Primary Examiner*—V. Srivastava

*Attorney, Agent, or Firm*—Burns, Doane, Swecker & Mathis LLP

[57] ABSTRACT

The constituent parts of a semiclosed respirator (1) are all set in a housing (2). When a push button (616) of a mouthpiece unit (6) is pressed with a chewing piece (617) held between upper end lower teeth, the supplying of a gas to be inhaled, which flows at a predetermined flow rate, through a gas supply pipe (84) is started. When an control lever (633) is pressed, a large quantity of gas is supplied through a gas supply pipe (85), end the removal of water from the mouthpiece unit is carried out. A carbon dioxide adsorption device (7) is of a so-called cartridge type held detachably in a container (3), and can be replaced by a new one easily. A large quantity of gas is supplied automatically in an emergency from a gas supply pipe (86) to an inhalation air passage (32), and an auto-valve mechanism (12) adapted to discharge a gas automatically when the inner pressure of the respiration passage has increased is provided thereon. An expiration air bag (9) is provided at its bottom portion with a drainage means, in which a draining action is made automatically via a water discharge port (96) in accordance with a respiration action. According to the present invention, a semiclosed respirator of a high safety which can be used conveniently even by a beginner can be provided.

11 Claims, 15 Drawing Sheets

SEMICLOSED RESPIRATOR

TECHNICAL FIELD

The present invention relates to a diving respirator. More particularly, the present invention pertains to a semiclosed-type respirator constituted so that it regenerates an expiration gas recovered from a mouthpiece by passing the gas through a carbon dioxide adsorption unit, supplies the thus regenerated gas and a fresh gas to be inhaled which flows a constant flow rate from a respiration gas bomb to the mouthpiece as inhalation gasses, and discharges excess gasses outside.

BACKGROUND ART

Diving respirators can generally be divided into two types, wherein one is an open-type respirator and the other is a closed or semiclosed-type respirator. The open-type respirator is constituted such that the entire gas once breathed is discharged outside the respirator, while the closed or semiclosed-type one is provided with a mechanism for making the breathed gas respirable again.

In a diving manner using an open-type respirator, a same amount in volume of gas is respired irrespective of an ambient pressure, or the diving depth. This means that the consumption ratio of the respiration gas increases according to the increase in value of the ambient pressure. Where a gas bomb is provided, in other words, the amount of the respirable gas is limited, a diving period of time is shortened as the diving depth increases.

In contrast, according to a closed or semiclosed-type respirator, although a compressed gas as the respiration air source is utilized as like as an open-type respirator, a constant amount in weight of gas can be respired irrespective of an ambient pressure. Hence, in the closed or semiclosed-type respirator, the consumption rate of the respiration gas is constant irrespective of the depth. Therefore, an amount of respiration gas which must be carried is extremely small compared to that required for the open-type respirator. Further, by changing a mixing ratio of the respiration gas, it enables to dive for a prolonged period of time into such a depth into which a divine with the open-type ones cannot be reached.

Accordingly, the closed-type and semiclosed-type respirators have a benefit that they are light and are capable of diving deeply for a long period of time in comparison with the open-type respirator. However, the conventional closed-type and semiclosed-type respirators have been developed for use in special diving operations, military affairs and the like, so that they are only equipped with minimized safety mechanisms but are not provided with mechanisms for emergencies which tend to occur frequently. This means that the usage of these respirators requires a relatively exhaustive training and therefore hobbyist divers cannot easily utilize these respirators.

However, accompanied by increase in population of hobbyist divers, there has been increased a demand for diving utilizing the closed-type or semiclosed-type respirators without requiring much complicated operations or skills. By the way, a closed-type respirator is equipped with an oxygen concentration sensor and the like, and requires relatively extensive training for divers to handle, control and monitor such equipment, whereas a semiclosed-type respirator has no such equipment and therefore it is not necessary for a diver to receive training for handling these equipment. Thus, a person other than experts can relatively easily handle a semiclosed-type respirator.

FIG. 15 shows a whole structure of a conventional-type semiclosed respirator. The semiclosed respirator 1000 comprises a respiration gas bomb 1001, a carbon dioxide adsorption unit 1002, a mouthpiece 1003, an expiration air bag 1004 and an inhalation air bag 1005, wherein the mouthpiece 1003 is connected via a flexible inhalation tube 1007 and a flexible expiration tube 1008 to the inhalation air bag 1005 and he expiration air bag 1004, respectively. Further, the expiration air bag 1004 is provided with a gas discharging valve 1008 for controlling a pressure value in the respiration gas circulatory system.

The expiration gas of a diver is fed to the expiration air bag 1004 and flows therefrom through the carbon dioxide adsorption unit 1002, thereby carbon dioxide is removed from the gas. The gas passed through the carbon dioxide adsorption unit is then supplied into the inhalation air bag 1005. While, a fresh inhalation gas supplied from the respiration gas bomb 1001 flows into the inhalation air bag 1005, which in turn is mixed with the gas regenerated through the carbon dioxide adsorption unit 1002 as mentioned above, and the resultant mixed gasses are inhaled through the mouthpiece 1003 by the diver.

It is extremely convenient if the thus-constituted semiclosed respirator be utilized in a manner easily and readily compared to the conventional ones. In order to utilize the semiclosed respirator easily and readily, the conventional semiclosed respirator must be improved in the following points:

First, the constituent parts of the conventional respirator are arranged, as shown in FIG. 15, that a pair of air bags are located horizontally in parallel with each other so that they are positioned on the lungs of a diver when worn by the diver, and that the cylindrical carbon dioxide adsorption unit is placed vertically in a center position under the air bags. This layout of these parts has a disadvantage that air passages between the mouthpiece placed above the air bags and the carbon dioxide adsorption unit are long to cause respiratory resistance large.

Second, the carbon dioxide adsorption unit which is accommodated in the respirator for regenerating an expiration gas must be replaced by a new one. The replacement thereof is carried out such that a casing of a carbon dioxide adsorption unit is opened, the carbon dioxide adsorbent filled therein are removed, and new carbon dioxide adsorbent is then filled in place. In the filling operation, it is necessary to fill the carbon dioxide adsorbent uniformly. If the carbon dioxide adsorbent is not filled uniformly, the gas may be passed through the carbon dioxide adsorption unit without carbon dioxide being removed, that is, the adsorption capability of carbon dioxide may be degraded. Thus, the filling operation requires a skill and is difficult to carry out within a short period of time.

Third, in the semiclosed respirator, inner pressures of the mouthpiece, and the expiration and inhalation air passages both connected to the mouthpiece are almost equal to an ambient pressure, so that there is a possibility that water invades into the respirator via the mouthpiece from the outside. For example, when a diver is a beginner, the mouthpiece may drop from the diver's mouth. If the mouthpiece is off from the diver's mouth and water invades into the respirator from the mouthpiece, there is occurred a defect that the leak water deteriorates the carbon dioxide adsorption unit or the like. Accordingly, it is desirable that a mechanism for preventing water into the respirator is provided and that a mechanism for discharging water automatically when water invaded inside the apparatus. In consideration of the inhalation air passage, this problem can be solved by the provision of a check valve in a joint portion between the inhalation air passage and the mouthpiece for allowing a fluid to pass only in the direction from the inhalation air passage to the mouthpiece, whereas it cannot be solved for the expiration air passage by providing a check valve because the expiration air flows from the mouthpiece towards the expiration tube, and thus an another device must be provided to the expiration air passage. In contrast, as long as an open-type respiration is concerned, since an expiration tube is not provided and an inner pressure of the inhalation air tube is higher than an ambient pressure, the problem that water may invade into the respirator through the mouthpiece from the outside is not occurred.

DISCLOSURE OF INVENTION

In consideration of the above points, an object of the present invention is to provide a semiclosed respirator which can be handled easily compared to the conventional ones.

More specifically, an object of the present invention is to provide a semiclosed respirator which is capable at suppressing an increase of respiration resistance and of providing safety mechanisms including an air discharge valve, a drainage valve and the like in suitable locations by means of setting a layout of the respiration in an appropriate manner.

The other object of the present invention is to provide a semiclosed respirator in which a carbon dioxide adsorbent in a carbon dioxide adsorption unit can easily be replaced.

An another object of the present invention is to provide a semiclosed respirator which has a mechanism for discharging water from a mouthpiece easily.

A still another object of the present invention is to provide a semiclosed respirator which is capable of automatically discharging water invaded into the inner side thereof through a mouthpiece.

A still yet another object of the present invention is to provide a semiclosed respirator which is capable of supplying an inhalation gas when a diver requires a large amount of inhalation gas end of discharging a gas automatically from the inside thereof when the gas becomes excess therein with a simple structure.

While, an object of the present invention is to provide a semiclosed respirator which is capable of controllably supplying an inhalation gas from a gas bomb, of automatically stopping the supplying of inhalation gas when a mouthpiece comes off the diver's mouth, and of automatically preventing water invasion thereinto.

The other object of the present invention is to provide a semiclosed respirator which has air bags of low respiratory resistance and of high reliability.

An another object of the present invention is to provide a semiclosed respirator which utilizes a safety jacket used for wearing the respirator in order to supply an inhalation gas supplementary and automatically in an emergency, end to adjust buoyancy when surfacing and other operations.

A semiclosed respirator according to the present invention adopts a layout of constituent parts thereof as follows: That is, at an upper side of a respirator housing a carbon dioxide adsorption device contained unit is placed horizontally, at a lower side of which a respiration gas bomb is mounted so that it is oriented vertically, and at respective sides of the respiration gas bomb an inhalation air bag and an expiration air bag are placed vertically. Further, the above carbon dioxide adsorption device contained unit is constituted such that the carbon dioxide adsorption device is accommodated at a center thereof, at the respective sides of which an inhalation air passage and an expiration air passage are defined. The inhalation air passage is connected with the inhalation air bag and is also connected with a flexible inhalation tube which is connected to a mouthpiece unit. While, the expiration air passage is connected with the expiration air bag and is connected with a flexible expiration tube which is connected to the mouthpiece unit.

By adopting this configuration, such an advantage as a respiratory resistance is suppressed at a low level can be obtained. In addition, as the housing, a hollow type is adopted so as to enclose the respiration gas bomb and the inhalation end expiration air bags. In this case, the housing is formed therein with an opening portion which can be selectively opened and closed for replacing the respiration gas bomb, so that such a replacing operation and the like can easily be carried out.

Next, according the present invention, the carbon dioxide adsorption device contained unit has a constitution wherein a hollow casing having an opening at one side thereof and a lid releasably attached to the opening defines a sealed space, in which the carbon dioxide adsorption device is accommodated in a manner that it can be removed therefrom.

The replacement of the carbon dioxide adsorption device of the above constitution can be carried out by the simple steps of opening the lid, removing the carbon dioxide adsorption device, inserting a new one and then fastening the lid. Thus, the removal and filling of the carbon dioxide adsorbent is not required and therefore it is not occurred a situation in which the carbon dioxide adsorbent is filled unevenly.

The carbon dioxide adsorption device can be composed of an adsorbent-filled tube having a cylindrical section and an absorbent-sealed bag inserted into the adsorbent-filled tube. The adsorbent-sealed bag can be constituted such that it is rectangularly shaped as a whole and is divided by a plurality of sealing portions formed in parallel at a prescribed interval into a plurality of adsorbent-sealed portions, in each of which carbon dioxide adsorbent is sealed. In this case, the adsorbent-sealed bag is wound to be a cylindrical shape and in this condition is inserted removably into the adsorbent-filled tube. With this configuration, replacement of the carbon dioxide adsorbent can be carried out quite easily.

The carbon dioxide adsorption device can be constituted as follows. That is, an adsorbent-filling tube having an annular section is provided, which comprises air-permeable inner and outer tubes arranged coaxially, sealing plates attached on both sides thereof, and a partition plate for dividing a cylindrical adsorbent-filling portion into right end left sides at a halfway portion along the axial direction of the adsorbent-filling tube, wherein one side of the cylindrical adsorbent-filling portions divided by the partition plate is communicated at its outer circumferential portion with an inhalation air passage, whereas the other side of the cylindrical adsorbent-filling portions is communicated at its outer circumferential portion with an expiration air passage. With this constitution, a gas passage passing through the device is defined by a route that enters the carbon dioxide adsorbent-filling portion through the outer circumferential portion at one side of the carbon dioxide adsorption device, passes through the adsorbent-filling portion to reach the inner side of the inner tube, then flows along the inner tube, and thereafter passes through the inner tube and the other side of the carbon dioxide adsorbent-filling portion to reach its outer circumferential side.

Next, in a semiclosed respirator according to the present invention, an inhalation air passage which is communicated to a mouthpiece unit is connected with a gas supply passage for supplying a constant quantity of fresh inhalation gas via a flow control means from an respiration gas bomb, and, in addition, it is also communicated with a gas supply port which supplies a fresh inhalation gas from the the respiration gas bomb, the flow rate of which is larger than that of the fresh inhalation gas supplied through the gas supply passage. Further, in order to maintain the inner pressure of the inhalation air passage lower than a prescribed value, there is provided an air discharge port which allows to discharge the inhalation air outside from the inhalation air passage. According to the present invention, the following constitution is adopted as a control means for controlling opening and closing of the above gas supply port and air discharge port.

That is, the control means comprises a flexible pressure chamber which is communicated to the inhalation air passage and has a moving end wall for moving in first and second directions in response to a pressure of the inhalation air passage, the above-mentioned air discharge port formed in the moving end wall, a controlling rod which is pressed by an elastic force and is movable together with the moving end wall in a condition that the air discharge port is sealed, an operational member which is operated by an end of the control rod when it is travelled beyond a predetermined distance toward the first direction, a normally-closed valve which opens the gas supply port in response to the travelling of the operational rod, and an opening member which opens the air discharge port of the moving end wall closed by the control rod against the elastic force when the control rod travels beyond a predetermined distance toward the second direction.

In operation of the control means according to the present invention, in case that the pressure of the inhalation air passage lowers abnormally or it occurs when a diver breathes hastily to demand a large quantity of inhalation air, the flexible pressure chamber communicated thereto is contracted excessively and its moving end all is moved toward the first direction over the predetermined distance. As a result, the operational member is operated by the end of the control rod travelling together with the moving end wall to made the normally-closed valve open, whereby an inhalation air of high pressure is supplied excessively through the high-pressure inhalation air supply passage. Thus, in such an emergent case, a large quantity of inhalation air can be supplied automatically.

In contrast to this, when a pressure in the inhalation air passage elevates excessively, the flexible pressure chamber communicated to the inhalation air passage becomes an excessively expanded condition and its moving end wall travells toward the second direction over the predetermined distance. As a result, the opening member is operated to open the air discharge port which is normally closed by the control rod. Thus, an excess amount of inhalation air is discharged through the port end therefore an excessive increase in pressure of the inhalation air passage can be avoided.

It is preferable that the gas supply port, air discharge port and control means are assembled in the inhalation air passage defined at one side of the carbon dioxide adsorption device contained unit.

Next, a semiclosed respirator according to the present invention is provided with a flexible expiration air bag communicated to an expiration air passage for storing temporarily an expiration air which is recovered through the expiration air passage communicated to the mouthpiece unit, and the expiration air bag is provided therein with a flexible water-discharging air bag which is communicated with the expiration air bag through a check valve for allowing fluid to pass only in the direction from the expiration air bag to the water-discharging air bag. Further, the water-discharging air bag is communicated to the outside via a check valve which allows a fluid to pass only in the direction therefrom to the outside.

According to this configuration, water invaded from the mouthpiece unit, passed through the expiration air passage and stored in the expiration air bag, is forced to flow from the expiration air bag into the water-discharging air bag and is then discharged outside from the water-discharging air bag by an effect of the water-discharging air bag which is expanded and contracted in response to an respiration action.

It is preferred that the above expiration air bag and inhalation air bag are of the double wall structure having a flexible outer bag member and a flexible inner bag member. In order to suppress an increase of respiratory resistance when the bag is expanded or contracted, a flexible member is preferably fixed on the bag for controlling a deformation of the bag.

A semiclosed respirator according to an another aspect of the present invention is constituted to have a water-discharging gas supply pipe which induces a gas into a mouthpiece unit from a respiration gas bomb, a flow rate of the gas induced being higher than that of a fresh inhalation gas, a normally-closed valve placed between the water-discharging gas supply pipe and the mouthpiece unit, a manual control member mounted on the mouthpiece unit for shifting the normally-closed valve to be an open state, a water discharge valve which communicates the inside of the mouthpiece unit to the outside only when an inner pressure of the mouthpiece unit exceeds a predetermined value.

According to this arrangement, in a water discharging operation, the manual control member is operated to open the normally-closed valve, so that a large quantity of inhalation gas is supplied into the mouthpiece unit. As a result, the inner pressure of the mouthpiece becomes higher than the ambient pressure temporarily, to thereby open the water discharge valve temporarily. Whereby, water in the mouthpiece unit is discharged outside together with the gas via the water discharge valve.

Further, the semiclosed respirator of the present invention has the mouthpiece unit constituted as follows. That is, the mouthpiece unit of the present invention has an expiration-tube connecting portion communicated to the expiration tube through which an expiration air flows, an inhalation-tube connecting portion communicated to the inhalation tube through which an inhalation air flows, a respiration-air communicating chamber having an outer opening communicated to the outside, and a mouthpiece mounted on the outer opening. The respiration-air communicating chamber is provided with a gas supply port through which a fresh inhalation gas is supplied from a respiration gas bomb. The gas supply port is provided with a valve means. The expiration-tube connecting portion is provided with a check valve which allows a fluid to pass only in the direction from the respiration-air communicating chamber to the expiration tube, whereas the inhalation-tube connecting portion is provided with a check valve which allows a fluid to pass only in the direction from the inhalation tube to the respiration-air communicating chamber. Further, the valve means mounted on the gas supply port is provided with a press means which exerts an elastic force for maintaining the valve means to be a closed condition, and it can be changed over to an open condition against the elastic force by means of the manual control member. Furthermore, a chewing piece is arranged which, in response to the manual control member, travels from a position retracted in the mouthpiece to a position projected outward from the mouthpiece.

With this arrangement, the mouthpiece is chewed and in this condition the manual control member is operated, whereby the chewing piece is shifted to the projected position. The top side of the projected chewing piece is chewed between the upper and lower teeth in order to maintain the chewing piece in its projected position, so that the valve means is maintained to be an opening condition. As a result, the supplying of a constant quantity of fresh inhalation gas is started through the gas supplying port.

It is preferred that the expiration-tube connecting portion is also provided with a valve means which is constituted so that it is opened and closed in response to the valve means mounted on the above gas supply port. With this, in case that the mouthpiece comes off the diver's mouth during diving, the chewing piece returns to its retracted position and in response to this, the valve means is shifted to its closed condition under the effect of the elastic force. As a result, the expiration-tube connecting portion is closed, preventing water from invading inside through this connecting portion. Since the inhalation-tube connecting portion is provided with the check valve, water is not allowed to invade inside through this portion.

In still another aspect of the present invention, a semiclosed respirator is constituted to have a respirator main body, a safety jacket to which the main body is mounted, an air storing portion accommodated in the safety jacket, a supply pipe for supplying a gas to the air storing portion from a respiration gas bomb, and a valve means for opening end closing the supply pipe. With this arrangement, during surfacing, an inhalation air is supplied to the safety jacket so as to adjust buoyancy, which is convenient.

Further, it is preferable to have a supply pipe for supplying a gas stored in the air storing portion of the safety jacket to an inhalation system of the respirator main body and a valve means for opening end closing the supply pipe. In this structure, in case that the supplying of the inhalation air cut off due to an accident or the like, an inhalation air can be supplied from the safety jacket side.

BEST MODE FOR CARRYING OUT THE INVENTION

Figure 1:
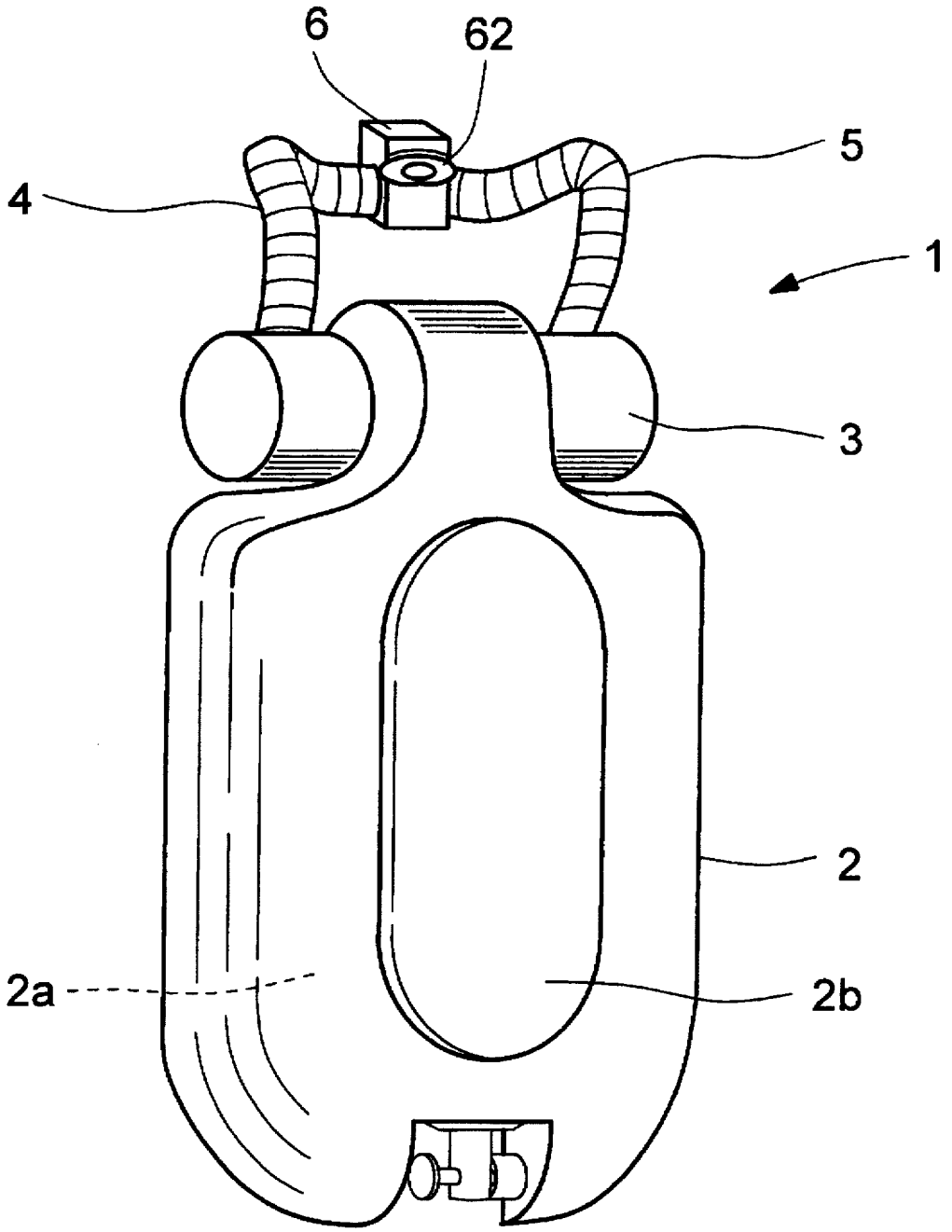
FIG. 1 is an outer perspective view of an example of a semiclosed respirator according to the present invention.

Referring now to the drawings, an example of the present invention is described.

FIRST EXAMPLE

Overall structure

Figure 2:
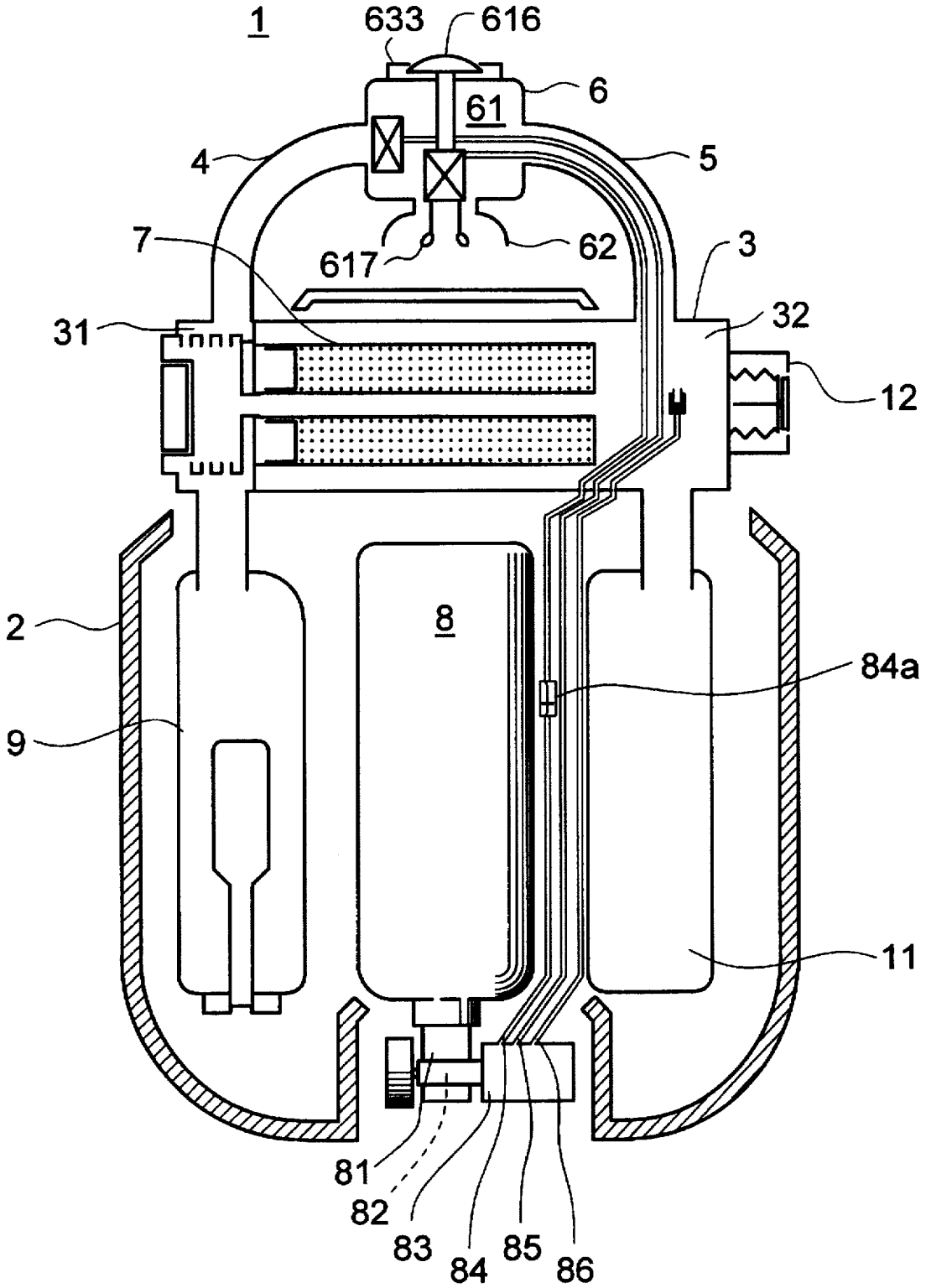
FIG. 2 is a schematic diagram illustrating a whole structure of the semiclosed respirator.

FIGS. 1 and 2 illustrate an overall structure of a semiclosed respirator according to the present example. As shown in FIG. 1, the semiclosed respirator 1 of the present example has a hollow housing 2, in which constituent parts explained hereinafter are accommodated. The hollow housing 2 is formed at one surface side with a back contact surface 2*a* which abuts on the back of a diver, whereas it is formed at its center with an opening for replacing a respiration gas bomb, on which a lid 2*b* is releasable, attached. On the upper end of the hollow housing 2 is mounted horizontally a container for a carbon dioxide adsorption device. The container is shaped cylindrically as a whole, and is connected at circumferential portions of its both sides with a flexible expiration tube 4 and a flexible inhalation tube 5. The expiration and inhalation tubes 4 and 5 are connected at their ends to a mouthpiece unit 6.

Referring to FIG. 2, there will be explained main constituent parts of the respirator 1 and their connecting states. As shown in this figure, the mouthpiece unit 6 has an expiration-air communicating chamber 61 which is communicated with the expiration and inhalation tubes 4 and 5. The other ends of the expiration and inhalation tubes 4 and 5, respectively, are communicated with both sides of the cylindrical container 3 in which the carbon dioxide adsorption device 7 is accommodated. More specifically, in the center of the container 3, the carbon dioxide adsorption device 7 is housed, at both sides of which an expiration air passage 31 and an inhalation air passage 32 are formed. In the hollow housing 2, at the lower side of the container 3 having the carbon dioxide adsorption device 7, there is arranged a respiration gas bomb 8 vertically at the center of the housing, across which an expiration air bag 9 and an inhalation air bag 11 are placed on both sides, respectively. The expiration air bag 9 is communicated to the expiration air passage 31 of the container 3, whereas the inhalation air bag 11 is communicated to the inhalation air passage 32 of the container 3.

The respiration gas bomb 8 is arranged so that a gas outlet port 81 thereof is positioned at its lower end, and this gas outlet port 81 is connected via a valve 82 (not shown) to a regulator 83. The regulator 83 functions to lower the gas pressure to about 8 to 9 kg/square centimeter. The regulator 83 is connected with six gas supply pipes, three of which are those for a pressure indicator, a BC jacket and a octopass (not shown). One of the remaining three gas supply pipes is that indicated by 84 which extends through the inhalation air passage 32 of the carbon dioxide adsorption device contained container 3 and the inhalation tube 5 to the inner side of the mouthpiece unit. At the halfway portion of the gas supply pipe 82, a flow-control orifice 84*a* is inserted, through which a gas is controlled of its flow rate to be about 4 to 5 litters per minute, to thereby supply to the mouthpiece. The other gas supply pipe 85 is a purging gas supply one for use in water discharging from the mouthpiece unit 6, and is also extended into he mouthpiece unit 6 as like as the above gas supply pipe 84. The remaining gas supply pipe 86 is for supplying an inhalation air in an emergency, a tip end of which is located in the inhalation air passage 32 in the container 3.

The carbon dioxide adsorption device contained container 3 is provided at its inhalation side end with an auto-valve mechanism 12. As mentioned hereinafter, this mechanism 12 controls the opening and closing of the gas supply pipe 86 and the auto-discharging of an excess gas.

The route of gas flow in general is as follows. An expiration air from the mouthpiece 62 of the mouthpiece unit 6 flows through the expiration tube and the expiration air passage 31 and then is stored in the expiration air bag 9. During an inhalation action, carbon dioxide is removed from the expiration air to be purified, stored in the bag 9 through the carbon dioxide adsorption device 7, and then is introduced into the inhalation air passage 32. This purified expiration air is then stored in part in the inhalation air bag 11 and the remaining part thereof is supplied to the mouthpiece unit 6 via the inhalation tube 5 for inhalation. In the mouthpiece unit 6, a constant flow rate of fresh inhalation gas is always introduced from the bomb 8 via the gas supply pipe 82, and these gasses are mixed and supplied as inhalation gasses.

Now, the respective parts of the respirator 1 of this example will be explained in detail.

Mouthpiece unit

Figure 3:
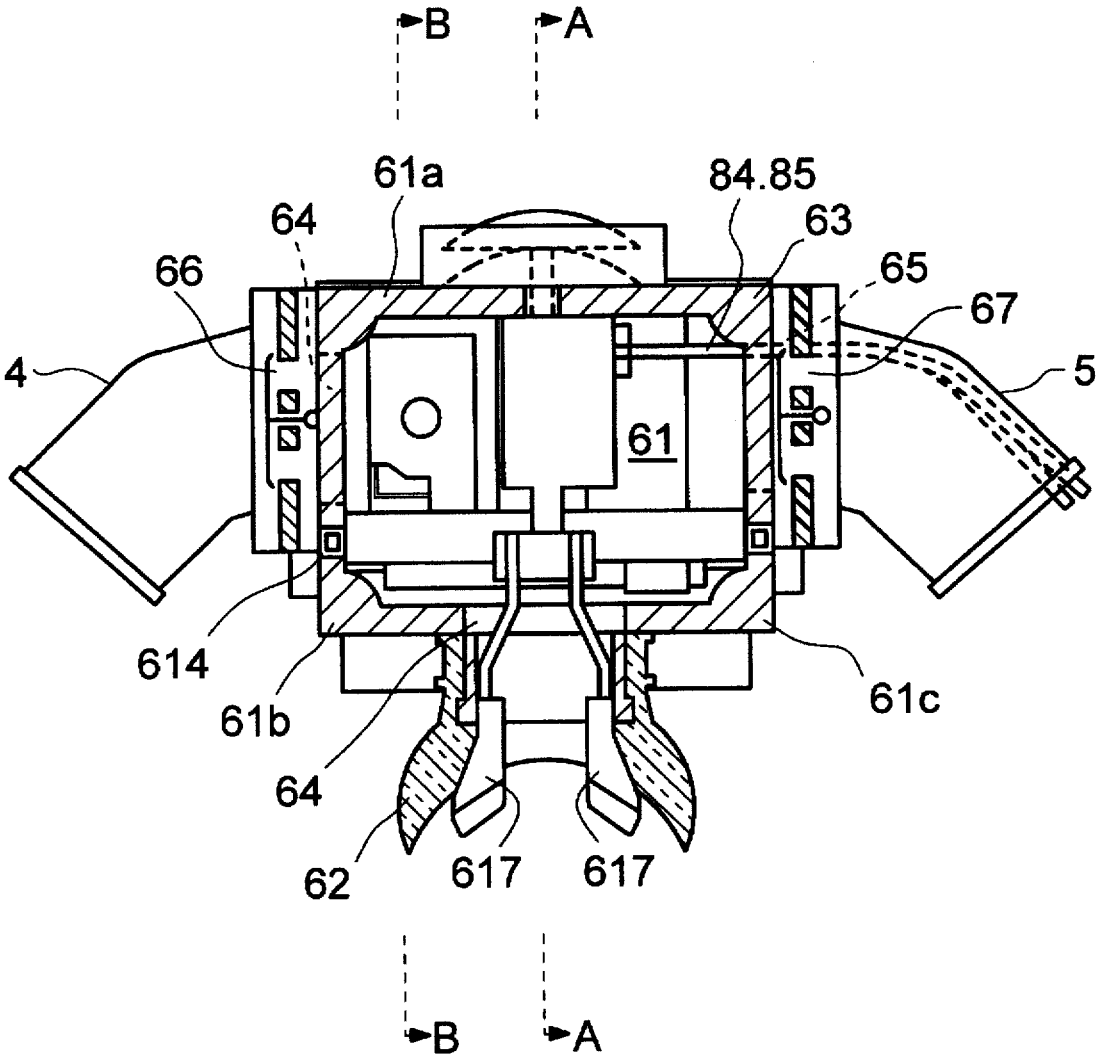
FIG. 3 is a schematic diagram illustrating a mouthpiece unit of the semiclosed respirator in a condition an upper wall being cut away.
Figure 4A:
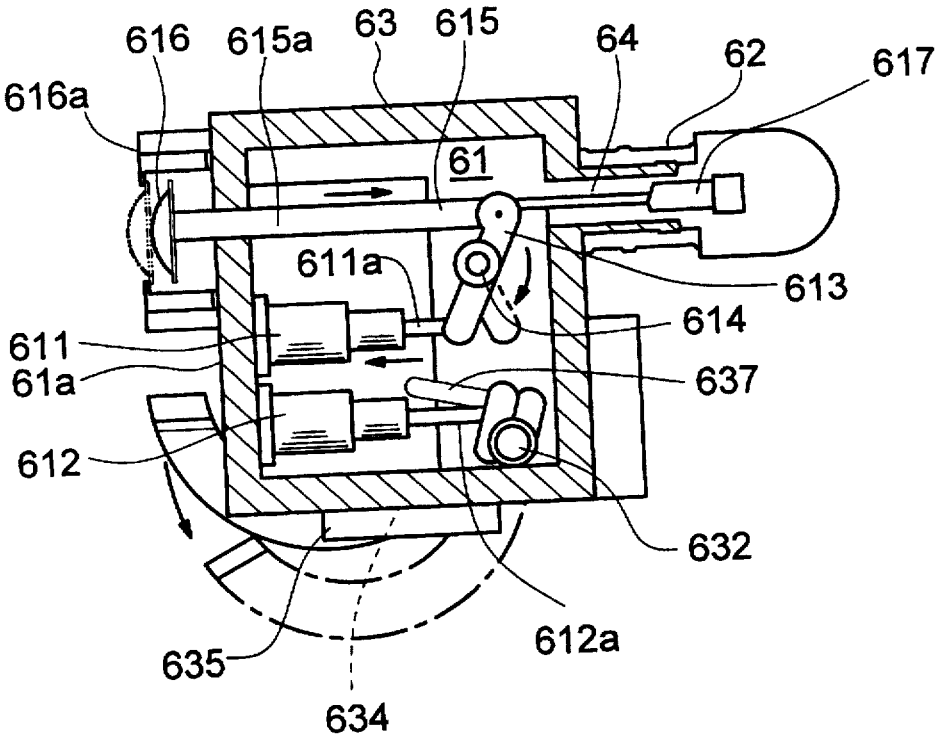
FIG. 4 a is a sectional view of the mouthpiece unit of FIG. 3, wherein (A) is a schematic sectional view taken along line A—A, while (B) is a schematic sectional view taken along line B—B.
Figure 4B:
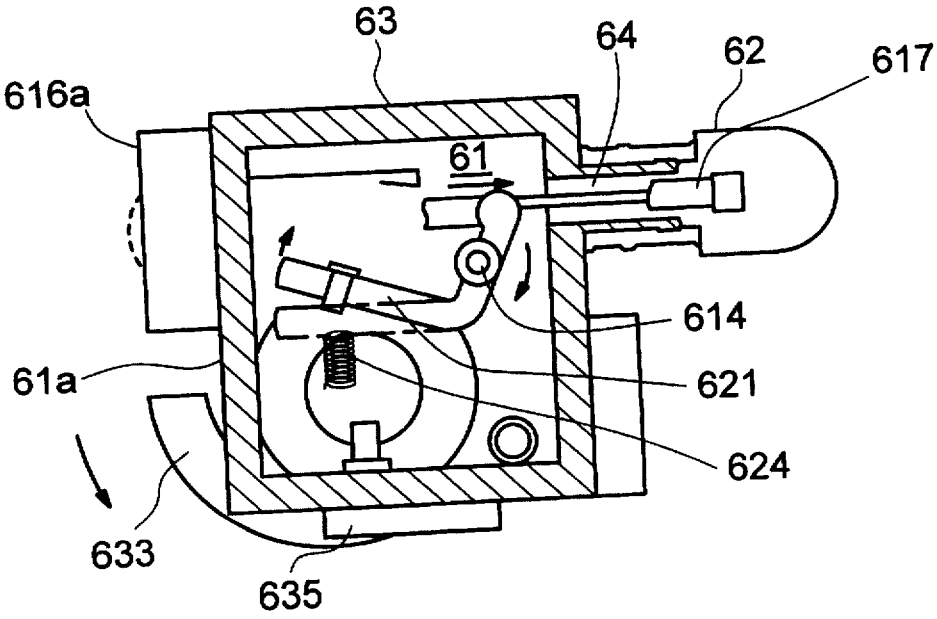
Figure 5:
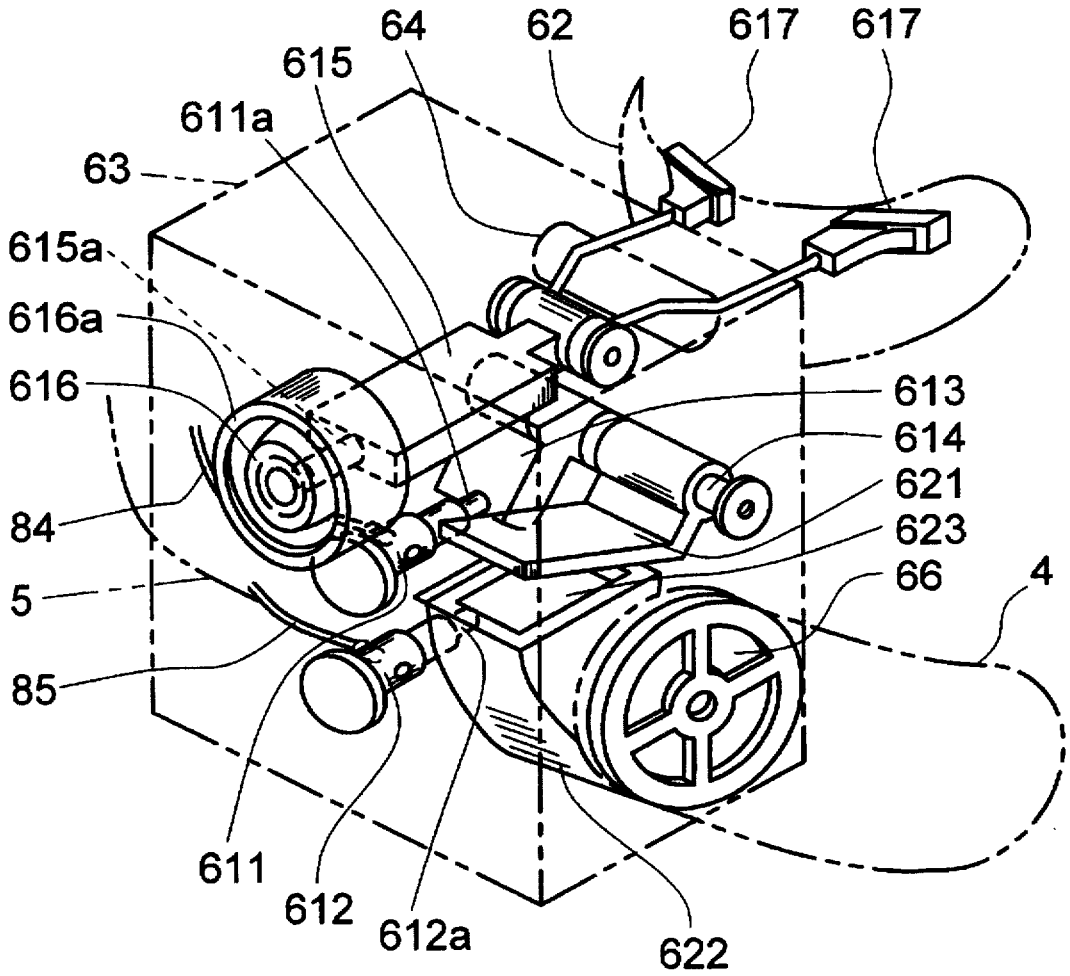
FIG. 5 is an explanatory view showing a main inner structure of an upper half portion of the mouthpiece unit of FIG. 3.

FIGS. 3, 4 and 5 show the mouthpiece unit of this example. The mouthpiece unit 6 of this example is composed of a respiration air communicating chamber 61 formed in a casing 63 having a shape of rectangular paralelepiped as a whole, and a mouthpiece 62 mounted on an opening 64 formed on one side surface of the casing 63. On right and left side surfaces are formed an expiration opening 64 and an inhalation opening 65, respectively. The expiration opening 64 is connected with the expiration tube 4 via a check valve 66 which allows fluid to pass only in the direction toward the expiration tube 4. Likewise, the inhalation opening 65 is connected with the inhalation tube 5 via a check valve 67 which allows fluid to pass only in the direction from the inhalation tube 5. Further, the gas supply pipes 84 and 85 arranged in the inhalation tube 5 through the inhalation opening 65 extend into the respiration air communicating chamber 61 in the mouthpiece unit. As shown in FIG. 4, the respiration air communicating chamber 61 is provided therein with valves 611 and 612 which are mounted on the inner surface of an end wall 61*a* of the chamber. The valve 611 is connected with the gas supply pipe 84, whereas the valve 612 is connected with the gas supply pipe 85. The valves 611 and 612 are made open by pushing control rods 611*a* and 612*a* thereof to thereby allow a gas to supply into the respiration air communicating chamber 61.

(Supply control mechanism of inhalation gas)

The end of the control rod 611*a* of the valve 611 for supplying an inhalation gas abuts on a lower end side of a swing plate 613 for shifting the rod. The swing plate 613 is supported at its mid portion along the upward and downward direction by a rotational shaft 614. The rotational shaft 614 is bridged rotatably across the both side walls 61*b* and 61*c* of the casing 63. The swing plate 613 is connected rotatably at its upper end with the proximal end of a laterally-travelling plate 615. The laterally-travelling plate 615 is positioned at the same height as the opening 64, and a columnar projection 615*a* at the end of this plate penetrates through the casing end wall 61*a* and projects outward. A disc push button 616 is mounted on the projected portion of the plate 615. The laterally-travelling plate 615 is always pressed toward the end wall 61*a* by an elastic force exerted by a spring member (not shown), and therefore the push button 616 mounted on its end is set in a condition pressed on a push-button seat 616*a* mounted on the casing end wall 61*a*.

While, the laterally-travelling plate 615 is connected at its proximal end with proximal ends of a pair of chewing pieces 617. The chewing pieces 617 have distal ends projecting through the opening 64 to reach the outside surface of the mouthpiece 62. These projected portions of the chewing pieces 617 are formed to be thick so that a diver can easily chew the projected portions between the upper and lower teeth.

As can be seen from FIGS. 4(A) and 5, the rotational shaft 614 is provided at its expiration-tube connecting side with an expiration-tube closing valve plate 621. Under the expiration-tube closing valve plate 621, an opening 623 of an expiration air passage 622 which is communicated with the expiration opening 64 is positioned. Between the valve plate 621 and the opening 623, a spring member 624 is arranged in a stretched condition. Therefore, in an normal condition, with the spring forces exerted by this spring and the spring member pressing the above swing plate 613, the opening 623 is closed by the valve plate 621. However, where the push button 616 is pressed, the rotational shaft 614 is rotated, and in response to this, the expiration-tube closing valve plate 621 turns upward to open the opening 623 of the expiration air passage, whereby the expiration air passage becomes communicated with the respiration air communicating chamber 61 in the mouthpiece unit.

The operation of the above described inhalation gas supply control mechanism will be explained. In a normal condition wherein the push button 616 is not pressed, the valve 611 provided at the end of the inhalation gas supply pipe 84 is in a closed condition. Likewise, the opening 623 of the expiration air passage 622 is in a condition being closed by the valve plate 621. In this condition, when the push button 616 is pressed against the elastic force, the laterally-travelling plate 615 travels toward the mouthpiece 62 to project the chewing pieces 617 connected to its proximal end outwardly from the mouthpiece 62. At the same time, the swing plate 613 is turned toward the arrow direction as shown in FIG. 4 about the rotational shaft 614 by means of the proximal end of the laterally-travelling plate 615, and the control rod 611*a* is pressed by the lower end of the swing plate. As a result, the valve 611 is made open and the supplying of an inhalation gas is started. The push button and laterally-travelling plate 615 tend to return to their initial positions by the elastic force applied thereto. However, by means that a diver chews the chewing pieces 617 projecting from the mouthpiece 62 between the teeth and shuts the mouth with maintaining the chewing condition, the above opening condition is maintained. Thus an inhalation gas is supplied which flows at a constant flow rate continuously.

While, when the push button is being pressed, the expiration-tube closing valve plate 621 is also turned toward the arrow direction to open the opening 623 of the expiration air passage 622. As a result, the expiration tube 4 becomes in communication with the respiration air communicating chamber 61 of the mouthpiece unit via the check valve 66. Hence, a respiration action is allowed. When the mouthpiece 62 is removed from the mouth after diving, the respective parts are allowed to return to their initial positions by means of the elastic force, whereby the supplying of an inhalation gas is stopped.

If a diver drops the mouthpiece 62 by mistake, water may be invaded through the mouthpiece 62. Since the check valve 67 is provided at the connecting portion of the inhalation tube 5, water invasion into the inhalation tube 5 can be avoided. Whereas, water may invade into the expiration tube 4. According to the present example, however, the expiration-tube closing valve plate 621 is provided which is driven in response to the push button 616, and if the above accident occurs, the expiration-tube closing valve plate 621 is forced to return to its initial position under the application of the elastic force, to thereby close the opening 623 of the expiration air passage 622. Hence, the invasion of water into the expiration tube a can be prevented.

As mentioned above, according to the present example, with simple operations of pressing the push button 616 and chewing the chewing pieces 617 between the teeth, the supplying of a gas to be inhaled can be started. In addition, by removing the mouthpiece from the mouth, the supplying of a gas to be inhaled can automatically be interrupted. Thus, without requiring any complicated operations, the supplying of a gas to be inhaled can be controlled. Furthermore, in the present example, if the mouthpiece is removed from the mouth, the expiration tube is automatically closed in response thereto, so that water invasion through the expiration tube can be prevented.

In contrast, conventionally, the control of supplying a gas to be inhaled is carried out by opening and closing a valve provided on the respiration gas bomb. More specifically, the valve is made open on the sea where the diving is actually carried out, and diving is carried out, and after diving the valve is made closed on the sea. This means that since a certain amount of gas is wasted which is not utilized for the diving, the diving period of time may be shortened by that amount, and therefore a gas is not effectively consumed. On the contrary, in the present invention, as mentioned above, after chewing the mouthpiece, the push button 616 is pressed so that the supplying of a gas is started automatically, whereas by removing the mouthpiece from the mouth, the supplying of a gas is interrupted automatically. Hence, there is an advantage that a gas is prevented from being wasted.

(Purge gas supplying mechanism)

Next, in the present example, the discharging of water invaded into the respiration air communicating chamber 61 of the mouthpiece unit 6 is carried out, as explained below, by using an inhalation gas which is supplied into the respiration air communicating chamber 61 from the gas bomb.

Figure 6:
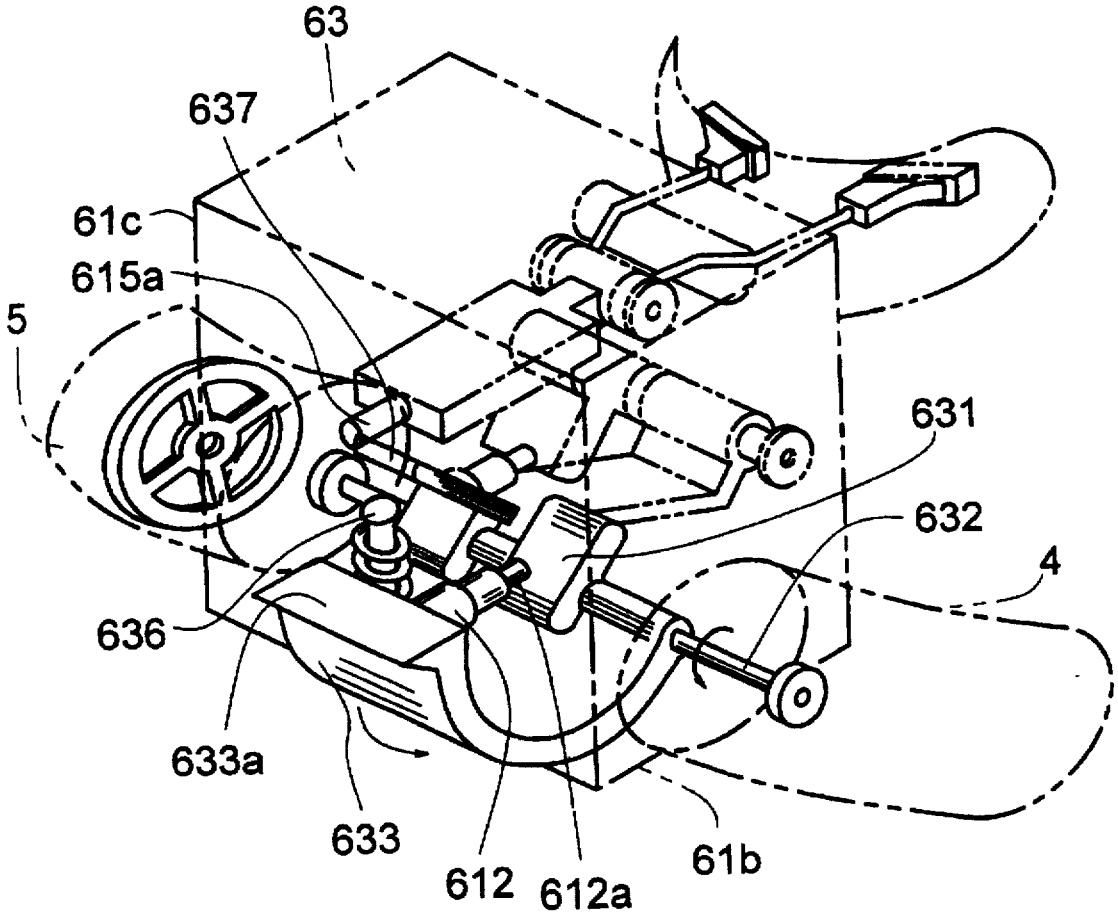
FIG. 6 is an explanatory view showing a main inner structure of a lower half portion of the mouthpiece unit of FIG. 3.

Referring FIGS. 4 and 6, the gas supply pipe 85 extends into the respiration air communicating chamber 61 of the mouthpiece unit as mentioned above, the end of which is connected to the valve 612. At a position opposed to the end of the control rod 612*a* of the valve 612, the swing plate 631 is located, the proximal end of which is fixed to the rotational shaft 632. The rotational shaft 632 is bridged rotatably between the end walls 61*b* and 61*c*.

The rotational shaft 632 is fixed with the proximal end of a purge lever 633. The purge lever 633 has the distal end 633*a* which is positioned outside the end wall 61*a* of the casing 63 of the mouthpiece unit. On the other hand, at the bottom surface of the casing 63 of the mouthpiece unit, thee is formed a purge hole 634 having a check valve. On the outer side of the purge hole 634, a lid 635 for closing the hole is provided. The lid 635 is provided with a control rod 636 having a coil spring, and it is usually maintained in a position closing the purge hole 634 by the force of the coil spring. When the control rod 636 is pressed against the spring force, the lid 635 moves away from the purge hole 634, whereby the purge hole 634 is shifted to be a condition in which, by the effect of the check valve arranged therein, a fluid is allowed only to pass outwardly. Above the control rod 636, a control lever 637 is arranged, the proximal end of which is fixed to the rotational shaft 632.

The water discharging operation will be explained. When a diver pushes the end 633*a* of the purge lever 633 downward, the rotational shaft 632 fixed to the proximal end of the lever is rotated toward the direction denoted by an arrow in FIG. 6. The rotational shaft 632 is fixed with the proximal ends of the swing plate 631 and the control lever 637 as well. Therefore, as the rotational shaft rotates, in response to this rotation, these parts are also turned toward the arrow direction and push the control rod 612*a* and the control rod 636 facing thereto, respectively. As a result, the valve is made open, through which a large quantity of an inhalation gas is discharged. At the same time, the lid 635 becomes away from the purge hole 634, whereby fluid is allowed to pass toward the outside via the purge hole 634 having the check valve. Accordingly, the water in the respiration air passage is forced to discharge outside through the purge hole 634 by the effect of the discharged inhalation gas.

When the pushing of the purge lever 633 is released, the respective parts return to their initial positions by the spring force exerted from the coil spring of the control rod. More specifically, the valve 612 is made closed and at the same time the purge hole 634 having the check valve is also made closed by the lid 635. As explained above, according to the present example, the water discharging operation can be carried out easily without requiring any skill.

In the present example, the reason why the above purge hole 634 having the check valve is provided with the lid 635 is that, if the lid is not provided, a respiration air may leak outside through the purge mole 634 by a respiration action in a normal condition.

Next, the above-constituted purge gas supply mechanism is utilized as a source of a gas to be inhaled in an emergency.

For example, where the supplying of gas to be inhaled from the inhalation tube side is reduced on an account of any reason, or where a large quantity of gas to be inhaled is required, the purge lever 633 is operated, whereby a required amount of gas to be inhaled can be supplied.

Carbon dioxide adsorption device

Figure 7:
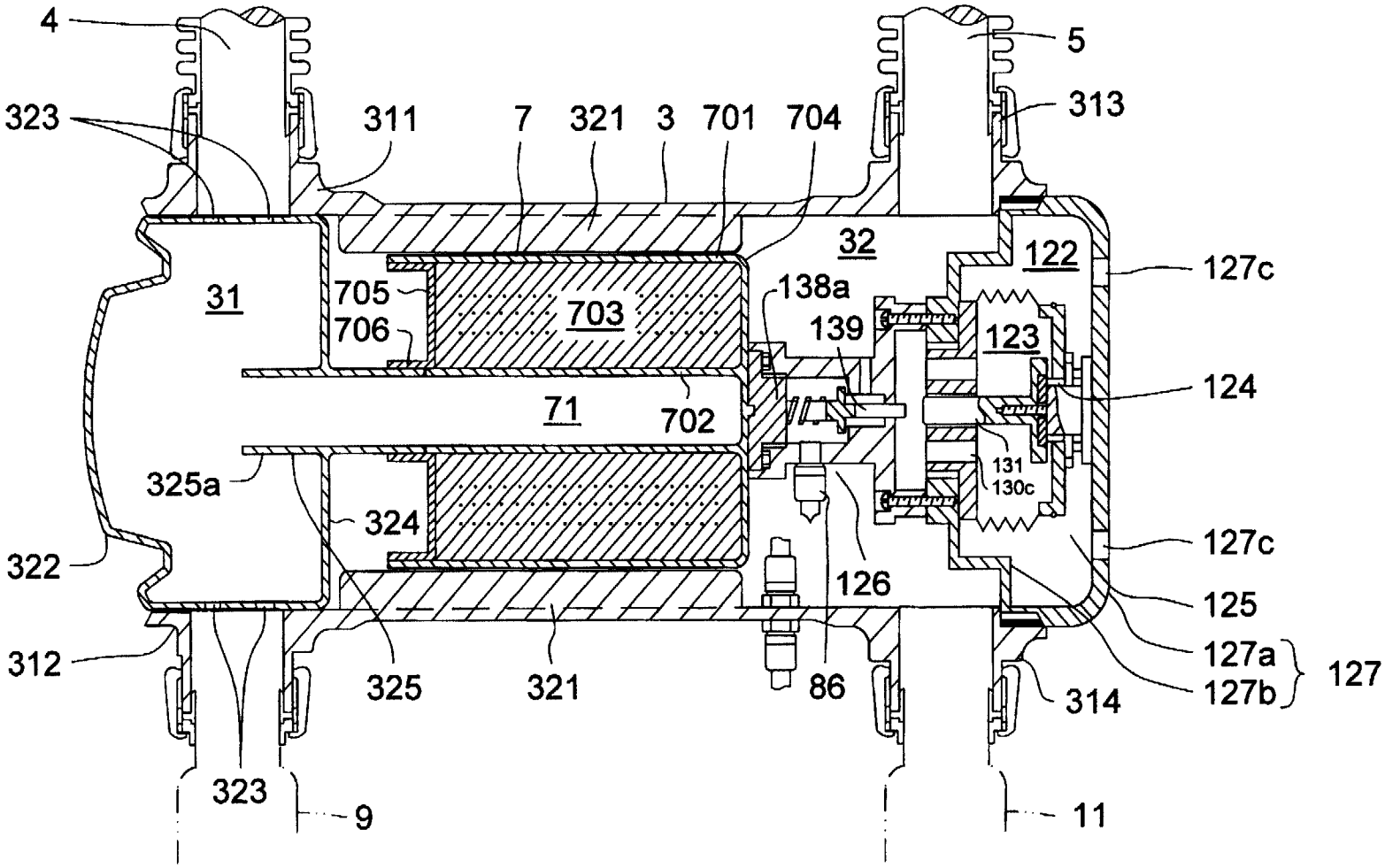
FIG. 7 is a partial sectional view showing a portion where a carbon dioxide adsorption device and an auto-valve mechanism are installed.

Referring mainly to FIG. 7, there will now be explained the carbon dioxide adsorption device 7 of the semiclosed respirator of the present example.

In the present example, the carbon dioxide adsorption device 7 is accommodated n the container 3 having a cylindrical shape as a whole. An outer circumferential portion of one side of the container 3 is formed at its upper and lower sides with an expiration-tube connecting portion 311 and an expiration-air-bag connecting portion 312, to which the expiration tube 4 and the expiration air bag 9 are connected, respectively. An outer circumferential portion of the other side of the container 3 is also formed at its upper and lower sides with an inhalation-tube connecting portion 313 and an inhalation-air-bag connecting portion 314, to which the inhalation tube 5 and the inhalation air bag 11 are connected. Inside the container 3, ribs 321 are formed at an equal interval on an inner circumferential surface of the center portion thereof, and the carbon dioxide adsorption device 7 having an annular section is inserted inside these ribs.

A hollow cylindrical lid 322 is fixedly screwed into the opening at the side of the expiration-tube connecting portion of the container 3 in a sealed condition. In the outer circumferential wall of the lid 322, a number of expiration air communicating holes 323 are formed. Therefore, the hollow portion of the lid functions as an expiration air passage 31 communicating the expiation tube 4 with the expiration air bag 9. Further, at the center of the circular end surface 324 of the lid 322, a pipe 325 is arranged to penetrate, through which the expiration air passage 31 is communicated to the hollow portion 71 of the carbon dioxide adsorption device 7.

To the other side opening of the container 3, a hollow bottom lid 127 is fixedly screwed in a sealed condition, in which an auto-valve mechanism 12 as mentioned hereinafter is accommodated. The inhalation air passage 32 is defined between the bottom lid 127 in the container 3 and the carbon dioxide adsorption device 7.

The carbon dioxide adsorption device 7 is constituted so that a carbon dioxide adsorbent is filled in an annular space defined by an outer tube 701 and an inner tube 702. These inner and outer tubes are closed at their one ends with an integrally-formed circular end wall 704, whereas at the other ends thereof, only a space for filling the carbon dioxide adsorbent 703 is closed by a ring-shaped plate 705. At the inner circumferential edge of the ring-shaped plate 705, a ring-shaped connecting portion 706 is formed, into which an end of the pipe 325 of the lid 322 of the above-mentioned container is inserted.

The inner and outer tubes of the carbon dioxide adsorption device 7 are made of air-permeable material. For example, they may be made of a porous or meshed material. Thus, the expiration air passage 31 is in a condition communicating with the inhalation air passage 32 through the pipe 325 and the carbon dioxide adsorption device 7.

The carbon dioxide adsorption device 7 of the present example is itself of a so-called cartridge type and is designed to replace the device itself after diving. That is, after diving, the lid 322 of the container 3 is made open and the carbon dioxide adsorption device 7 is removed the therefrom. Then, a new carbon dioxide adsorption device is inserted and the lid 322 is closed. The inserted carbon dioxide adsorption device 7 is defined of its axial position by a contacting surface **138*a* of the bottom lid 127 and the pipe 325 of the lid 322**, and is defined of its radial position by the ribs formed on the inner circumferential surface of the container.

Accordingly, the carbon dioxide adsorption device is made to be a cartridge type, so that there is no need to carry out such an operation as the filling of the carbon dioxide adsorbent or the like which requires skill. Hence, the replacement of the device can easily be carried out.

In addition, according to the present example, the end portion **325*a* of the pipe 325 of the lid 322 is set projected into the inner space of the lid. Therefore, water invaded into the expiration air passage 31 through the expiration tube 4 is interrupted to flow by the end 325*a* of the pipe 325, which reduces the possibility that the invaded water flows into the side of the carbon dioxide adsorption device 7. Thus, the pipe 325** functions as a so-called waterstopping tube.

Expiration and inhalation air gas

Figure 10:
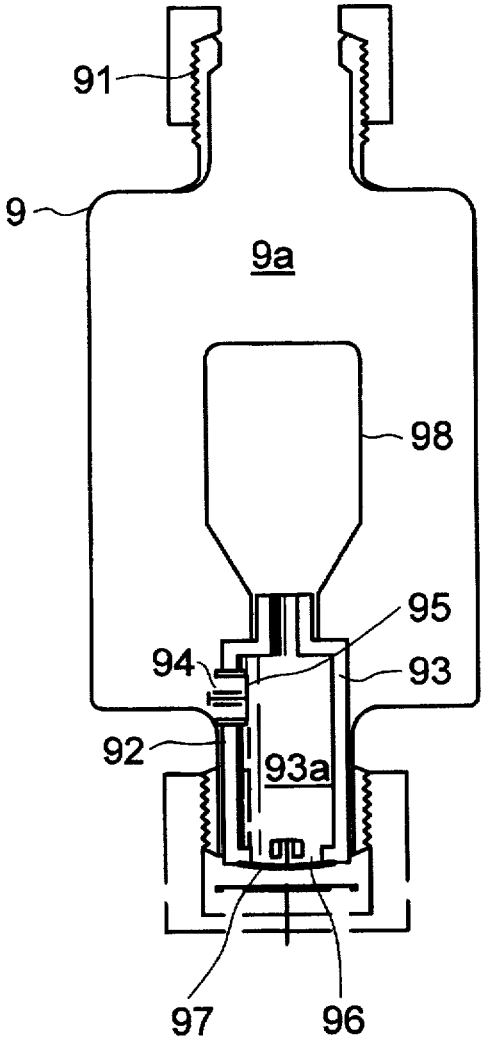
FIG. 10 is an explanatory view showing a structure of an expiration air bag, wherein (A) is a schematic longitudinal sectional view, whereas (B) is a schematic longitudinal sectional view taken along perpendicularly to (A).
Figure 10:
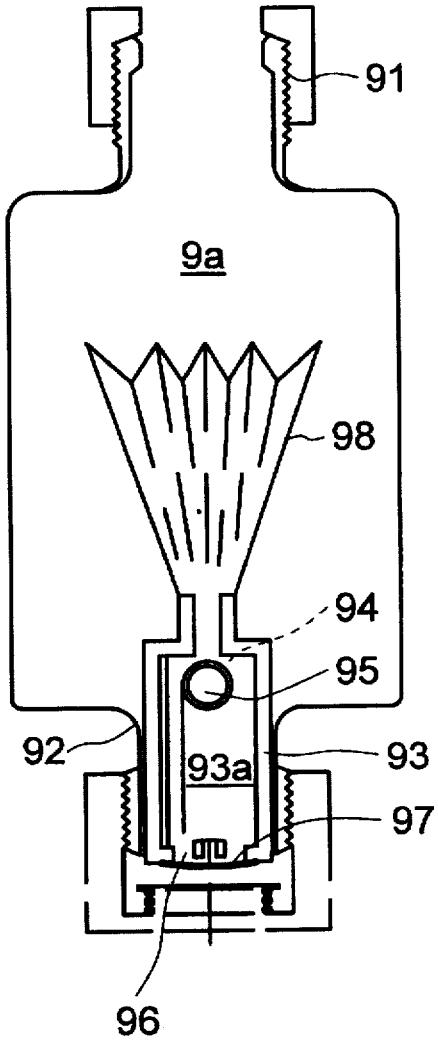

FIG. 10 shows the expiration air bag 9. The air bag 9 is a flexible one made of a flexible material and so is expanded and contracted in accordance with a respiration action. The air bag 9 is formed at its upper end with a connecting portion 91 which is connected to the connecting portion 312 formed on the above-mentioned container 3. The air bag 9 has a lower opening 92, into which a rigid cylindrical pipe 93 is inserted. The cylindrical pipe 93 is formed at its outer circumferential wall with a communicating hole 94, in which a check valve 95 is attached. With this check valve 95, fluid is only allowed to pass in the direction from the inner space **9*a* of the air bag 9 to the inner space 93*a* of the cylindrical pipe 93. The cylindrical pipe 93 is formed at its bottom portion with a water discharge hole 96, in which a check valve 97 is also attached. By means of the check valve 97, fluid is allowed to pass only in the direction from the inner space 93*a* of the cylindrical pipe 93 to the outside. While, the cylindrical pipe 93 is connected at its upper opening with a bellows-like flexible bag 98**.

In the thus constitute expiration air bag 9, water invaded therein is discharged outside as follows. The water invaded into the inner space **9*a* of the air bag 9 through the expiration tube 4 and the like is stored on the bottom portion thereof. The air bag 9 is expanded and contracted in response to a respiration action. During an inhalation action, the air bag 9 is contracted to the extend that the bag 98 contained therein is pressed, and the bag 98 is contracted accordingly. After that, the air bag 9 is expanded by an expiration action, the bag 98 is also expanded to recover its initial shape by its restoring force. During this expansion, the check valve 95 is made open to cause the water stored in the air bag 9 to induce into the inner space 93*a* of the cylindrical pipe 93 via the communicating hole 94. The water flown into the cylindrical pipe 93 is discharged outside through the water discharge opening 96 as the bag 98 becomes contracted because the inner pressure of the inner space 93*a*** is elevated to make the check valve open.

Whereas, the inhalation air bag 11 has the same structure as that of the expiration air bag 9, except that it is not provided with the cylindrical pipe 93 for discharging water, the be 98 and the check valves 95, 97.

Auto-valve mechanism

Figure 8:
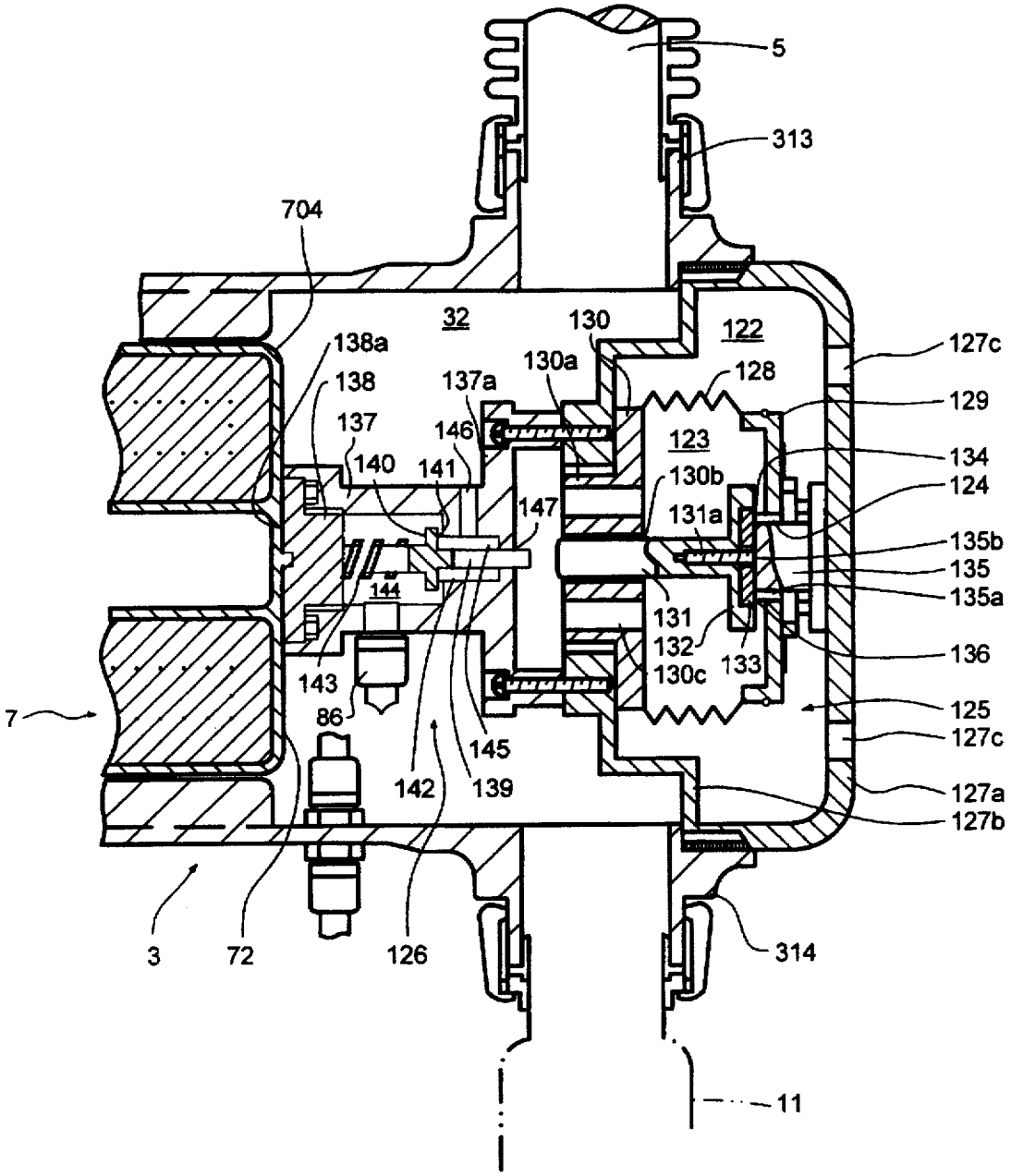
FIG. 8 is an enlarged sectional view showing a portion of the auto-valve mechanism of FIG. 7 in an enlarged scale.
Figure 9:
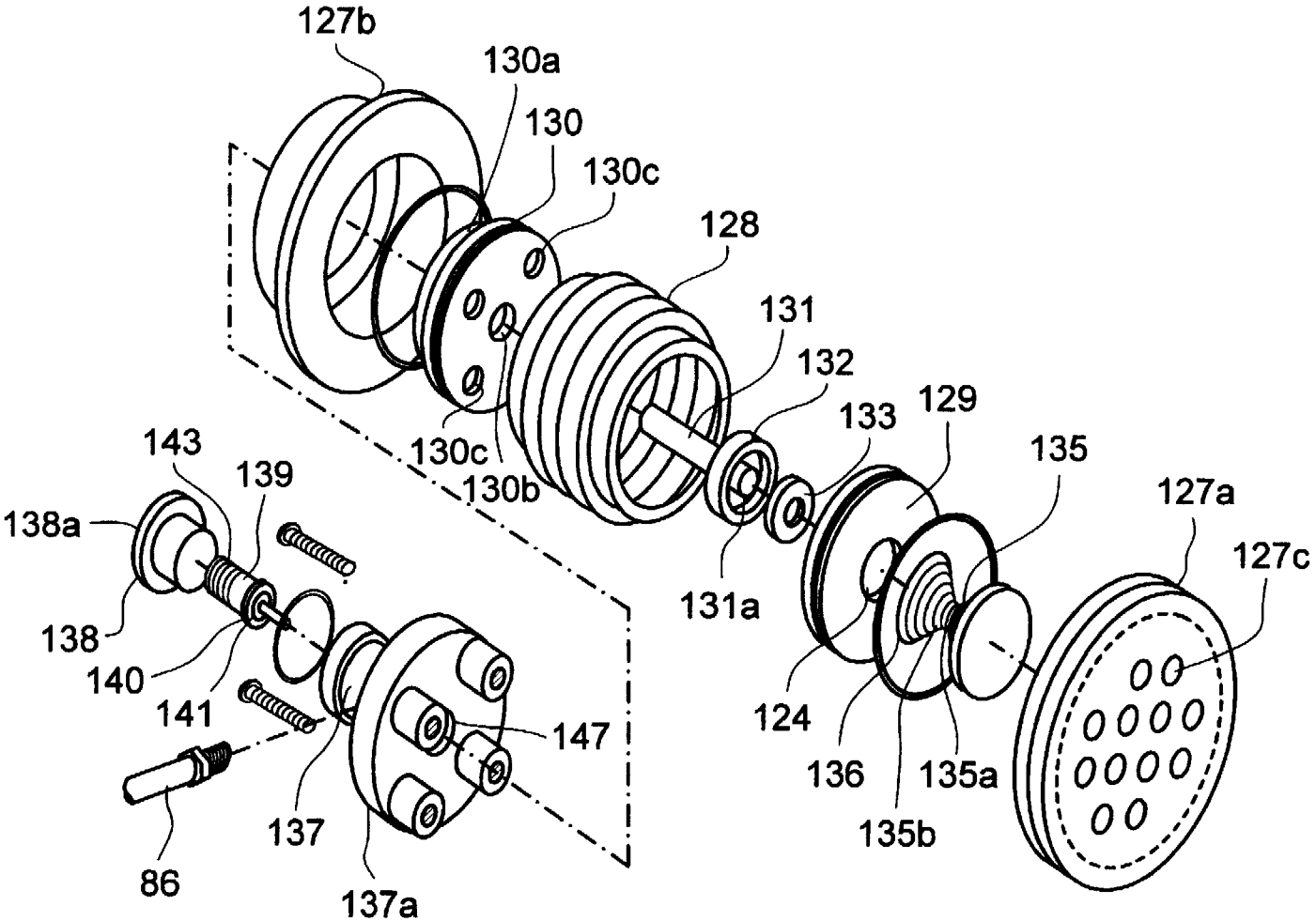
FIG. 9 is an exploded perspective view showing a portion of the auto-valve mechanism of FIG. 7.

Next, with reference to FIGS. 7, 8 and 9, the auto-valve mechanism 12 of the present example will be explained. Usually, a diver breathes a gas to be inhaled which is stored in the inhalation air bag 11 and is supplied through the inhalation tube 5, together with a gas to be inhaled which is supplied at a constant flow rate directly to the mouthpiece unit 6 from the gas bomb 8 via the gas supply pipe 84. However, there is sometimes required a gas to be inhaled, the amount of which is larger than that supplied usually. On the other hand, an expiration air is stored in the expiration air bag 9 via the expiration air tube 4, and therefore it is necessary to adopt a countermeasure against such a case that the air bag becomes full and is not able to store an expiration air any more. The auto-valve mechanism 12 or this example is directed to the above both matters.

As shown in FIG. 7, the auto-valve mechanism 12 of this example is assembled in the inhalation air passage 32 which is defined at one side of the container 3 which is communicated to the inhalation tube 5 and the inhalation air bag 11. The auto-valve mechanism 12 is basically constituted by an outer pressure chamber 122 an inner pressure of which is maintained as an ambient pressure, an inner pressure chamber 123 an inner pressure of which is maintained as the inhalation air passage 32, a normally-closed valve mechanism 125 for closing a communicating hole 124 between the pressure chambers 122 and 123, a normally-closed valve mechanism 126 for closing an opening of the gas supply pipe 86 positioned in the inhalation air passage 32.

The outer pressure chamber 122 is formed inside the bottom wall 127 of the container. That is, as shown in FIGS. 8 and 9, the bottom wall 127 is composed of an outer disc-shaped member 127*a* and an inner ring-shaped member 127*b*, in which the outer pressure chamber 122 is formed. The outer disc-shaped member 127*a* is formed with number of through holes 127*c*, by means of which the inner pressure of the outer pressure chamber 122 is maintained to be the same as a ambient pressure. In contrast, the inner ring-shaped member 127*b* acts as a partition plate dividing the outer pressure chamber 122 and the inhalation air passage 32.

The inner pressure chamber 123 is defined in the outer pressure chamber 122 by cylindrical bellows 128, and ring-shaped end plates 129 and 130 mounted on both sides of the bellows. The ring-shaped end wall 129 is formed with an opening 124 which allows to communicate the inner pressure chamber 123 with the outer pressure chamber 122 and is usually closed by the normally-closed valve mechanism 125. Whereas, the other ring-shaped end plate 130 located inside has a boss 130*a* passing through the inner ring-shaped member 127*b* constituting the bottom lid 127, and the boss 130*a* is formed with a center opening 130*b* and a plurality of communicating holes 130*c* arranged concentrically. The inner pressure chamber 123 is communicated to the inhalation air passage 32 through these communicating holes.

The normally-closed valve 125, which closes the communicating hole 124 between the outer and inner pressure chambers 122, 123, has a control rod 131 arranged along the center line of the inner pressure chamber 123, the distal end of which passes loosely through a center opening 130*b* of the ring-shaped end plate 130. The control rod 131 is formed at its proximal end with a large-diameter flange 132. On an outer side end surface of the flange 132, a ring packing 133 is mounted to form a valve seat. A ring valve body 134 having a shape so as to project toward the ring packing 133 is formed on an inner circumferential edge of the communicating hole 124 of the ring-shaped end plate 129 facing to the ring packing 133. A control-rod supporting member 135 is mounted on an inner side surface of the outer ring member 127*a* constituting the bottom lid 127, which passes through the communicating hole 124 loosely. The end surface 135*a* of the supporting member 135 is one for supporting the control rod. A guide rod 135*b* is projected from the center of this surface 135*a*, which is slidably inserted into a guide hole 131*a* formed in an end surface of the control rod 131. Accordingly, the control rod 131 is supported by the supporting member 135 in a condition that it is slidable along its axial direction.

The control rod 131 is being pressed toward the side of the ring-shaped end plate 129 by the application of the inner pressure of the inner pressure chamber 123, whereas the ring-shaped end plate 129 is being pressed toward the side of the flange 132 of the control rod 131 by means of a coil spring 136. Therefore, in a normal condition, the valve body 134 of the ring-shaped end plate 129 is pressed against the valve seat (ring packing) 133 formed on the flange 132 of the control rod 131, whereby the communicating hole 124 is set to be a closed condition.

Next, the normally-closed valve mechanism 126 for closing the gas supply pipe 86 arranged in the inhalation air passage 32 has a cylindrical housing 137, on one end of which there is integrally formed a large-diameter flange 137*a* whose portion is threaded into the inner ring-shaped member 127*b*. The other end of the housing 137 is closed by an end plate 138. The end plate 138 has a circular end surface 138*a* which is a contact surface contacting with the end surface of the carbon dioxide adsorption device 7.

A control rod 139 is arranged in an inner space of the housing 137. The control rod 139 is formed integrally at its midway portion with a flange 140 which has a ring-shaped valve seat 141 formed on an end surface thereof, and a ring-shaped valve body 142 is formed on an inner circumferential edge of the housing 137 so as to face to the ring-shaped valve seat 141. The control rod 139 is always pressed toward the valve body 142 by a coil spring 143, and therefore the inner space of the housing 137 is in a condition divided into a communicating hole 144 connected with the gas supply pipe 86 and a communicating chamber 145. The communicating chamber 145 is communicated to the inhalation air passage 32 via a communicating hole 146 formed in the housing 137 and a communicating hole 147 formed in the center of the flange 137*a* of the housing.

The end of the control rod 139 passes through the communicating hole 147 of the flange 137*a* to project toward the inhalation air passage and faces to the end of the control rod 131 of the above-mentioned normally-closed valve mechanism 125 across a predetermined gap.

(Supplying of a gas to be inhaled in an emergency)

According to the thus constituted auto-valve mechanism 12, the pressure of the respiration air passage is maintained to be the same as an ambient pressure by means of the stretchable bellows 128 which partitions the outer pressure chamber 122 and the inner pressure chamber 123.

The control rod 131 is not moved until it contacts with control rod 139 of the normally-closed valve mechanism 126 by the contraction of a bellows 128 caused by the pressure change in the inhalation air passage 32 occurred during a normal respiration action. However, where a diver requires a large amount of gas to be inhaled, the inner pressure of the inhalation air passage is lowered in response to this, and the inner pressure of the inner pressure chamber 123 is also lowered. As a result, the bellows 128 is further more contracted than usual and the control rod 139 of the normally-closed valve mechanism 126 is forced to move by the end of the control rod 131. When the control rod 139 is pressed, the normally-closed valve mechanism is made open to establish communication between the chambers 144 and 145. Thus, a large quantity of gas to be inhaled from the gas supply pipe 86 is started to supply to the mouthpiece unit 6 via the inhalation air passage 32 and the inhalation tube 5.

After a large quantity of gas to be inhaled is thus supplied, the inner pressure of the inner pressure chamber 123 is elevated to return to be a normal range of pressure. Accordingly, the bellows 128 is expanded to make the control rod move away from the control rod 139 of the normally-closed valve mechanism 126. Then, the normally-closed valve mechanism 126 is returned to its closed state to stop the supplying of the gas to be inhaled. In the present example, the gas to be inhaled which is supplied from the gas supply pipe 86 is no restricted in flow rate, different from the gas supplied by the gas supply pipe 84 which is controlled to restrict the flow rate, and therefore inhalation gas demand in an emergency can be dealt with rapidly.

(Gas discharge operation in an emergency)

Next, a gas discharge operation in an emergency performed by the auto-valve mechanism 12 will be explained. Expiration air is stored in the expiration air bag 9, and, when the bag becomes full, it flows into the inhalation air side through the carbon dioxide adsorption device 7 and is stored in the inhalation air bag 11. In the case that both of the bags become full, the gas must be discharged from the respirator so as to recover the expiration gas, but otherwise an expiration action becomes difficult. When the respirator is filled therein with the gas, the pressure of the gas circulation system in the respirator becomes high above an normal pressure accordingly. As a result, the pressure in the inner pressure chamber 123 is also elevated, end therefore the bellows 128 is forced to expand, the degree of which is much larger than that during a normal respiration action. The control rod 131 is limited in its movement by the end surface 135*a* of the supporting member 135 which supports it in a movable condition. Thus, after that, only the end wall 129 moves away from the control rod 131 against the spring force of the spring 136, whereby the valve body 134 formed on the end wall 129 comes into a condition apart from the valve seat 133. Thus, the inner pressure chamber 123 comes into a condition communicating with the outer pressure chamber 122 via the communicating hole 124. The outer pressure chamber 122 communicates to the outside through a plurality of the through holes 127*c*. Therefore, the excess gas in the respirator is discharged to the outside through the holes 127*c*.

In the present example, the auto-valve mechanism 12 is located at the end of the carbon dioxide adsorption device contained container 3 which is mounted horizontally on the upper portion of the respirator. With the mechanism 12 being located in this position, in the normal course of diving, the auto-valve mechanism 12 is set on the upper portion of the respirator, so that there is a benefit that the gas discharging can easily be carried out through this portion.

After the excess gas is discharged outside, the inside of the respirator returns to be a normal pressure condition. In response to this, the bellows 128 is also contracted to return to be a condition wherein the communicating hole 124 of the end wall is closed.

As mentioned above, the auto-valve mechanism 12 of the present example is able to carry out both of the gas supplying operation and the excess gas discharging operation in response to the movement of the end wall 129 according to the pressure change in the inner pressure chamber 123. According to the present example, it is capable of carrying out the supplying of gas to be inhaled automatically, which was carried out manually in the past. Further, these automatic gas supplying end discharging mechanisms can be constituted in a compact manner.

SECOND EXAMPLE

Figure 11A:
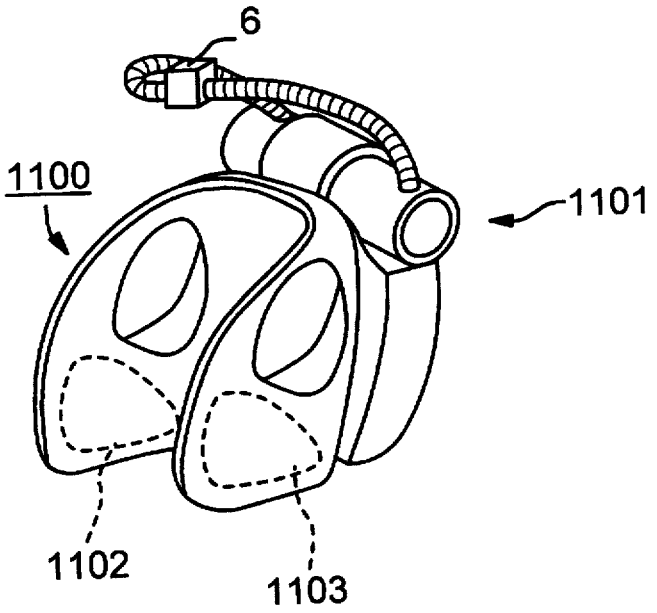
FIG. 11 is an explanatory view showing an another example of the present invention, wherein (A) is an outer perspective view and (B) is a schematic block diagram of its inhalation gas supplying system.
Figure 11B:
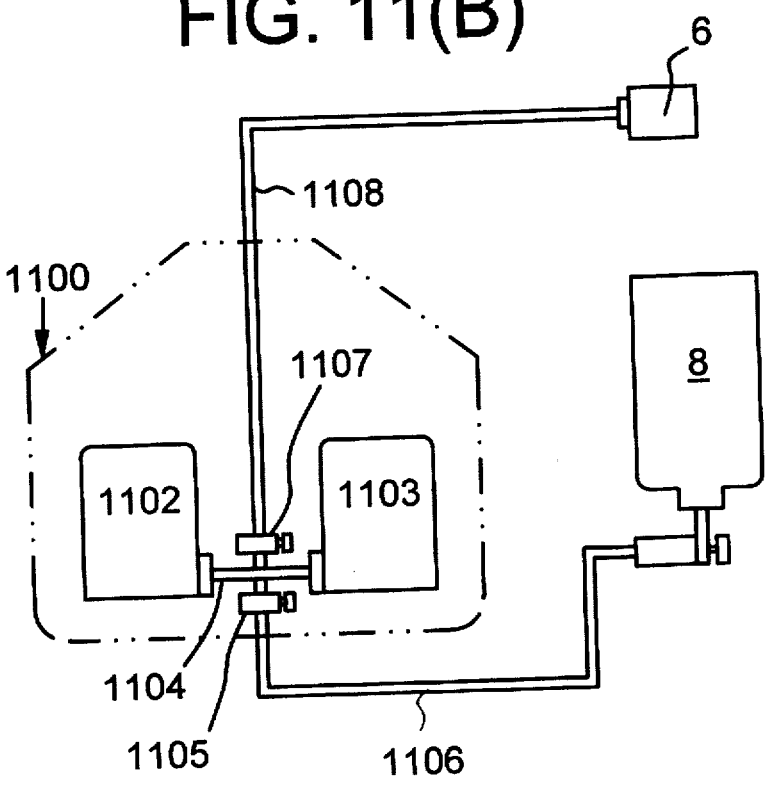

In FIG. 11, there is shown an another example of the respirator according to the present invention. A semiclosed respirator of this example is characterized by a safety jacket used for wearing a main body of the semiclosed respirator. That is, in the drawings, reference numeral 1100 denotes a safety jacket which is mounted thereon with a main body 1101 having the same structure as that of the above-mentioned semiclosed respirator 1, for example, end is designed to be carried on the diver's back.

The safety jacket 1100 of this example is, as shown in the drawings, accommodated therein with a pair of air storing bags 1102 and 1103. These bags 1102 and 1103 are communicated with each other via a communicating pipe 1104 which is connected via a valve 1105 with a supply pipe 1106 for supplying a gas from a respiration bas bomb 8 housed in the main body 1101. The communicating pipe 1104 is also connected via valve 1107 with a gas supply pipe 1108 which communicates to the inhalation gas system of the main body 1101.

In the semiclosed respirator of this example, by opening the valve 1105, inhalation air can be stored in the bags 1102 and 1103 of the safety jacket. Thus, during diving, in case of emergency such as the gas shortage of the gas bomb occurs, the air bags are damaged or the like, inhalation air can be supplied by opening the valve 1107.

Further, when a diver wants to surface during a course of diving, the valve is opened to supply a large quantity of gas to the bags 1102 and 1103 of the life jacket, so that buoyancy can be increased and the surfacing can easily be carried out.

Carbon dioxide adsorption device of another example

Figure 12A:
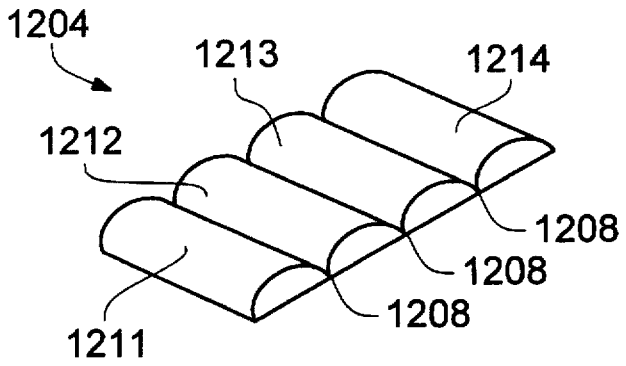
FIG. 12 is an explanatory view showing an another example of the carbon dioxide adsorption device, wherein (A) illustrates a bag in which a carbon dioxide adsorbent is sealed, (B) is an exploded view of the carbon dioxide adsorption device, and (C) is a schematic sectional view of its carbon dioxide adsorption tube.
Figure 12B:
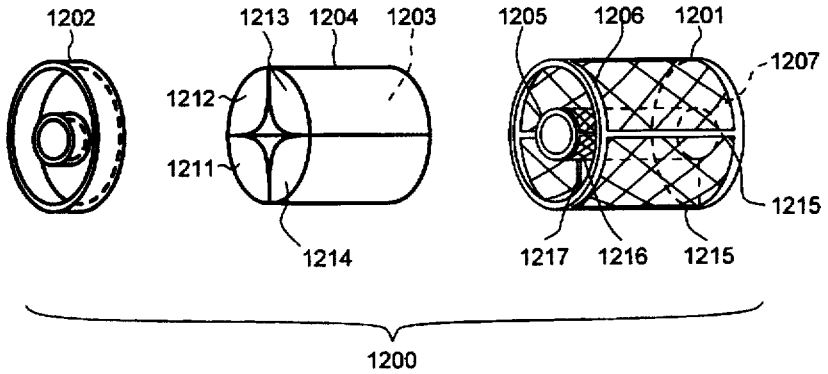
Figure 12C:
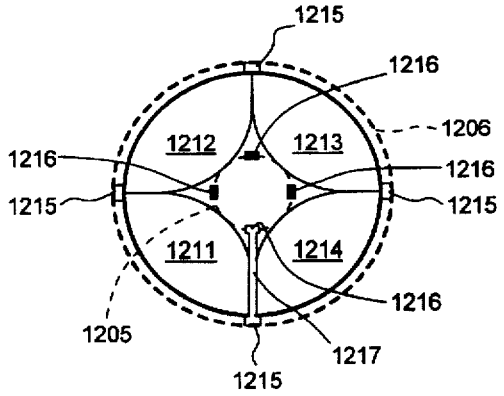

FIG. 12 illustrates a modification of the carbon dioxide adsorption device 7 shown in FIG. 7. A carbon dioxide adsorption device 1200 shown in this figure is constituted by a container 1201, a lid 1202, and an adsorbent-sealed bag 1204 in which a carbon dioxide adsorbent 1203 is sealed. The container 1201 has inner and outer sleeves 1205 and 1206 arranged concentrically and an end wall 1207 for closing one ends of these sleeves. The container 1201 is, for example, an integrally-formed molded part and the inner and outer sleeves are of a meshed structure. At an opening end of the container 1201, a ring-shape drop lid 1202 is inserted between the outer circumference of a inner sleeve 1205 and the outer sleeve 1206 in a condition leaving no clearance. The ring-shaped drop lid forms a closing end wall which receives the communicating pipe 325, and corresponds to the end wall 1207 of the opposed side.

In an annular space defined by the container 1201 and the lid 1202, the bag 1204 in the form as shown in FIG. 12(A) is inserted in a wound state. This bag 1204 is made of an air-permeable material and is rectangularly shaped as a whole, in which there are defined four semi-columnar carbon dioxide adsorbent sealed portions 1211, 1212, 1213 and 1214 by means of sealing portions 1208 formed in parallel with one another along the width direction at equal intervals. A carbon dioxide adsorbent is sealed in each of these sealed portions. The bag 1204 is made, for example, of a thermoplastic synthetic resin material, and the sealing portions may be formed by means of heat sealing.

The container 1201 is divided therein by a partition plate 1217 extending between a reinforcement ribs 1215 and 1216 respectively formed on the outer and inner sleeves. The wound bag 1204 is inserted into the container such that the joining portion thereof is positioned at the partition plate 1217. The lid 1202 is attached to the container after the bag is inserted.

As mentioned above, according to the present example, the filling of a carbon dioxide adsorbent can be carried cut by the steps of winding the bag 1204 into which the carbon dioxide adsorbent is sealed beforehand and inserting it into the container 1201. Therefore, even a beginner can easily carry out the filling and replacing of the carbon dioxide adsorbent. In particular, according to this example, the bag is formed therein with the sealing portions, so that the winding there of can easily be carried out and the insertion thereof can also be carried out without any difficulty.

Another example of the carbon dioxide adsorption device

Figure 13A:
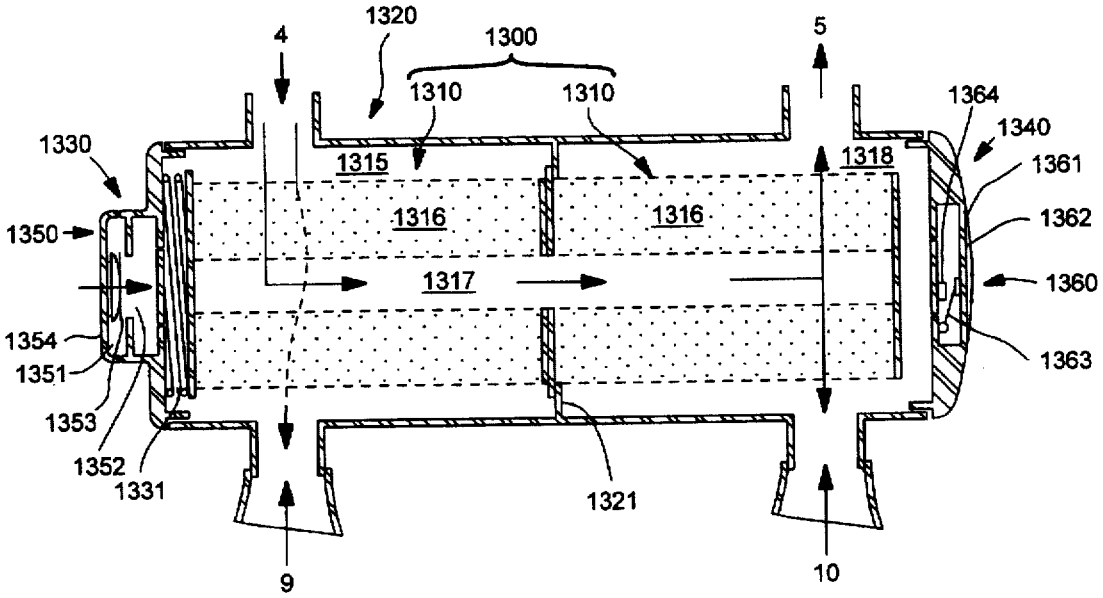
FIG. 13 is a view showing a still another example of the carbon dioxide adsorption device, wherein (A) is a schematic sectional view thereof, and (B) is a schematic sectional view of its carbon dioxide adsorption tube.
Figure 13B:
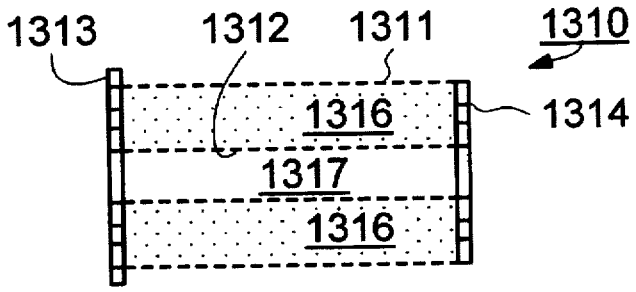

FIG. 13 shows an another example of the carbon dioxide adsorption device. A carbon dioxide adsorption device 1300 shown in the drawings is inserted into a cylindrical container 1320 with both ends thereof being closed. The carbon dioxide adsorption device 1300 is inserted into the container 1320 in a condition that two carbon dioxide adsorption tubes 1310 are connected along the axial direction.

The carbon dioxide adsorption tubes are of the same shape and are constituted by air-permeable outer and inner sleeves arranged concetrically and ring-shaped closing plates 1313 and 1314 for closing both ends of an annular sectional carbon dioxide adsorbent filling portion defined by the both sleeves. The closing plate 1313 has an outer diameter larger than that of the outer sleeve 1311, while the other closing plate 1314 has an outer diameter substantially equal to that of a outer sleeve.

The container 1320 into which the carbon dioxide adsorbent tubes 1310 is accommodated is provided in the middle portion along its axial direction with a ring-shaped stop plate 1321 formed on the inner circumferential surface. A the both ends of the container, lid members 1330 and 1321 are releasable threaded and fixed in an air tight manner. The inner diameter of the ring-shaped stop plate 1321 is set so that the above carbon dioxide adsorption tube 1310 can just pass therethrough. Therefore the lid member 1330 is removed and the carbon dioxide adsorption tube 1310 is inserted into the container 1320 from the side of the small diameter closing plate 1314, so that the large diameter closing plate 1313 comes into contact with the stop plate 1321. In this contacted condition, the remaining carbon dioxide adsorption tube 1310 is inserted from the same side to abut against the large diameter closing plate 1313 of the carbon dioxide adsorption tube 1310 which is inserted beforehand. Thereafter, the lid member 1330 is threaded to fix on the container opening. The lid member 1330 is provided at its inner side surface with a press spring 1331, and therefore when the lid member 1330 is threaded into, the carbon dioxide adsorption tube 1310 is pressed by the press spring 1331, whereby it is fixedly mounted in the container.

The inner space of the container 1320 is communicated at the side of lid member 1330 with the expiration tube 4 and the expiration air bag 9, whereas it is communicated at the side of the other lid member 1340 with the inhalation tube 5 end the inhalation air bag 11. This constitution is the same as that of the container 3 of the carbon dioxide adsorption device 7 as shown In FIG. 7.

In the present example, an expiration air passes along the annual space 1315 between the inner circumferential surface of the container 1320 and the carbon dioxide adsorption tube 1310 of the expiration air passage side and flows toward the expiration air bag 9. In addition, it passes through the outer sleeve 1311 of the expiration-side carbon dioxide adsorption tube 1310, the filling portion of the carbon dioxide adsorbent 1316 and the inner sleeve 1312, to flow into the center hole 1317 of the inner sleeve. Then it flows along the center hole 1317 of the inhalation-side carbon dioxide adsorption tube 1310, the carbon dioxide adsorbent 1316 and the annular space 1318, so that carbon dioxide is removed therefrom. The resultant regenerated gas flows into the inhalation air bag 10 or the inhalation tube 5.

According to the present example, the gas is at first induced from the outside of the outer sleeve of the carbon dioxide adsorption tube and is also discharged to the outside of the outer sleeve. Therefore, an expiration air flows into the inside from the outer circumferential surface having a large surface area at first, so that there is obtained such a benefit that moisture contained in the expiration air can effectively retained in an adsorbent portion placed near the outer circumferential portion having a large surface area of the expiration-side adsorption tube 1310.

Modification of the auto-valve mechanism

Next, in the example shown in FIG. 13, the lid members 1330 and 1320 attached to the ends of the container into which the carbon dioxide adsorption device is accommodated are provided with a water discharge mechanism 1350 and a fresh inhalation gas supply mechanism 1360, respectively. These two mechanisms perform the similar operations as those of the auto-valve mechanism 12 as mentioned before.

More specifically, the lid member 1330 at the expiration side is provided therein with a check valve 1351 constituting the water discharge mechanism 1350, and this check valve 1351 has a valve opening 1352 communicating an annular space 1315 arranged at the expiration side to the outside, a valve plate 1353 for closing the valve opening 1352, and a coil spring 1354 for pushing the valve plate 1353.

When water flows into the container 1320, the semiclosed respirator is made to tilt as a whole so that the side thereof in which the water discharge mechanism 1350 is assembled faces downward, and with maintaining this attitude, a diver sends into an expiration air, whereby the valve plate 1353 is forced to move against the coil spring 1354 to open the valve opening 1352. As a result, the invaded water is discharged through the valve opening to the outside, together with a part of the expiration air.

On the other hand, the fresh inhalation air supply mechanism 1360 which is assembled in the lid member 1340 positioned at the inhalation side has an opening 1361 communicating an annular space 1318 to the outside and a diaphragm 1362 closing the opening. The diaphragm 1362 is in contact with a demand lever 1363 so as to move in response to the deformation of the diaphragm 1362, and when the demand lever 1363 is moved toward inside over a predetermined distance, a demand valve 1364 in the closed state is shifted to become an open state. The demand valve 1364 is provided on a supply port of a supply pipe fop supplying a fresh gas to be inhaled from the respiration gas bomb. This supply pipe corresponds to the supply pipe 86 in the example shown in FIG. 7.

The diaphragm 1362 is always exposed to ambient, so that it is deformed inwardly as the inner pressure of the inhalation air system is lowered. If the inner pressure of the inhalation air system is lowered much more than that occurred during a normal respiration action, the diaphragm 1362 is deformed excessively inwardly to thereby push the demand lever 1363. As a result, the demand valve is made open through which an inhalation air is supplied in the inhalation air system to prevent unusual pressure drop of the inhalation air system.

Accordingly, in place of the auto-valve mechanism 12 of the example shown in FIG. 7, the water discharge mechanism and the fresh inhalation air supply mechanism can by provided at the both ends of the carbon dioxide adsorption device contained container.

Modification of the air bag

In FIG. 14, there is shown a modification of the inhalation air bag shown in FIG. 2. As shown in this drawing, an inhalation air bas 1400 of this example is formed to be a double wall structure having airtight outer and inner bag members 1402 and 1403 made of, for example, nylon, vinyl resin or the like. On the outer surface of the outer bag member 1402, two flexible stick members 1404 are attached, which are arranged in parallel with each other along the axial direction of the bag member. At least both end portions of each of the stick members 1404 are fixed on the bag members 1402. One or more than three of the stick member may be arranged. The outer and inner bag members 1402 and 1403 are formed at their openings 1405 and 1406 with a connecting port 1407 which is designed to connect with that of a carbon dioxide adsorption device contained container (corresponding to the connecting portion 314 of the container 3 shown in FIG. 7).

Figure 14A:
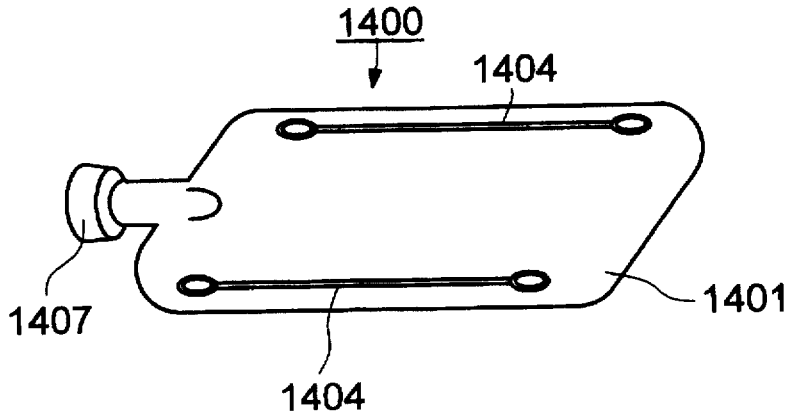
FIG. 14 is a view showing an another example of the air bag, wherein (A) is an outer perspective view, (B) is a schematic sectional view, (C) is an explanatory view showing an expanded condition thereof, end (D) is an explanatory view showing a contracted condition thereof.
Figure 14B:
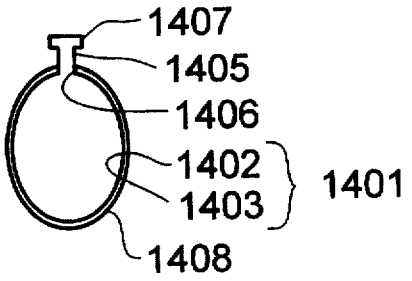
Figure 14C:
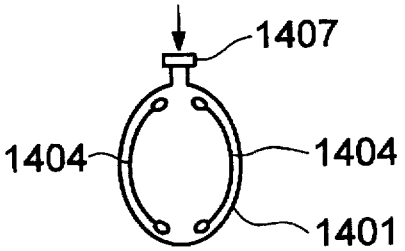
Figure 14D:
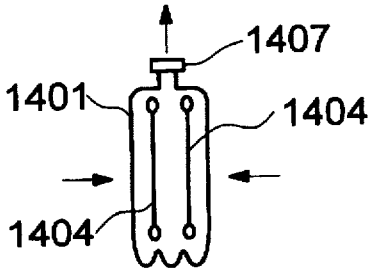
Figure 15:
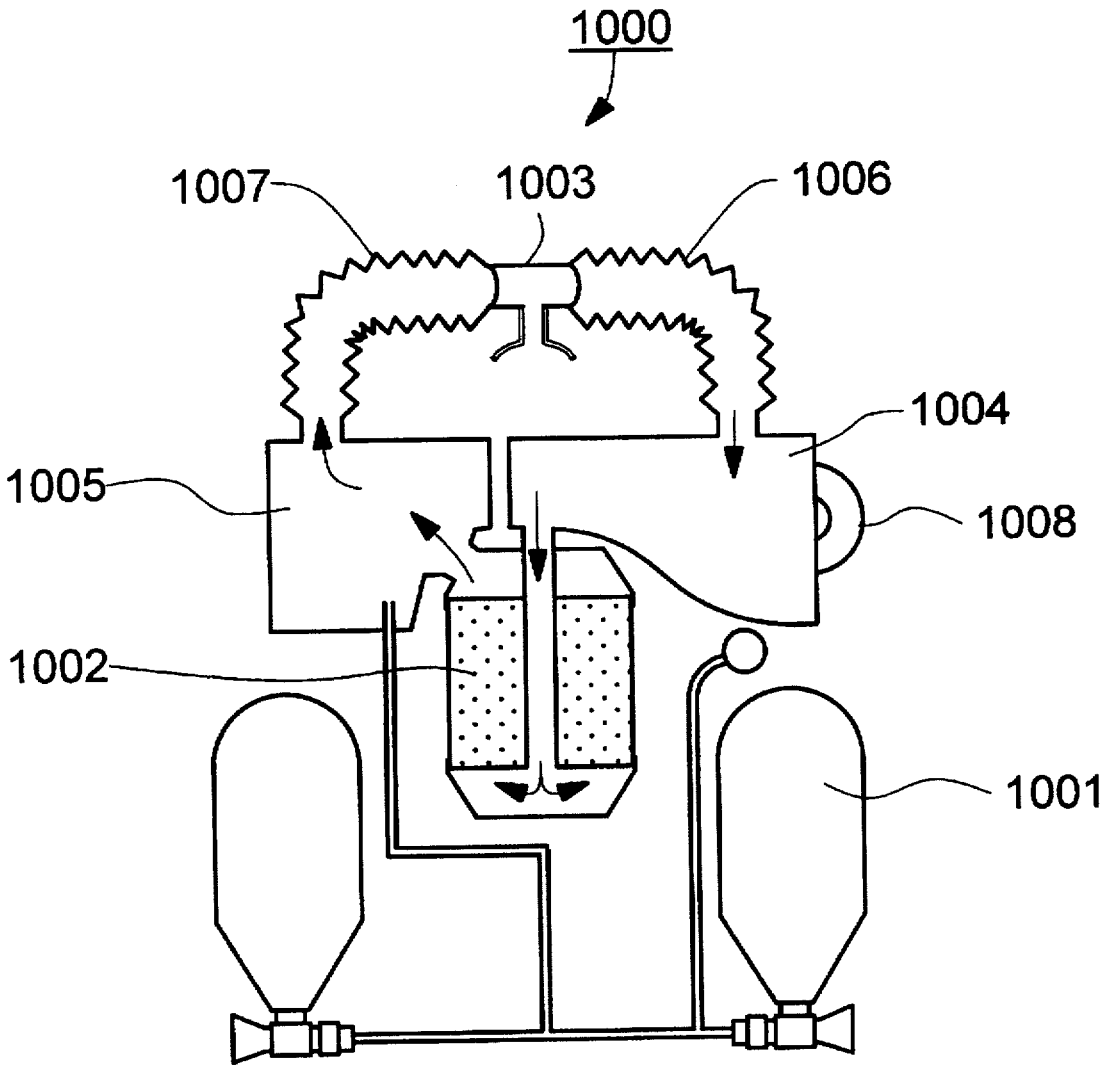
FIG. 15 is a schematic diagram of a conventional semiclosed respirator.

In the inhalation air bag 1400 of the present example, between the outer and inner bag members 1402 and 1403, there is formed an airtight air layer 1408, so that the bag body 1401 thereof do not shrink in a condition being rumpled. Further, the expansion and contraction of the bag body occurs, as shown in FIGS. 14(C), 14(D), along the lateral direction perpendicular to the axial direction, but not along the axial direction because of the stick members 1404 both sides of which are fixed on the bag body. Hence, the expansion and contraction of the bag body in accordance with a respiration action is occurred smoothly. Whereby, a gas flow resistance during expanding and contracting operations, that is, an respiratory resistance can be reduced.

In addition, it is of course to say that the expiration air bag shown in FIG. 10 can also made to have the double wall structure as mentioned above.

Industrial Applicability

In the semiclosed respirator according to the present invention, the layout of constituent parts thereof is set as follows. That is, the carbon dioxide adsorption device contained unit is arranged laterally on the upper portion of the respirator housing, the respiration gas bomb is positioned along the upward and downward direction below the unit, and the inhalation an expiration air bags are arranged at both sides of the respiration gas bomb along the upward and downward direction. In addition, the carbon dioxide adsorption device contained unit is constituted so that the carbon dioxide absorption device is housed in the middle portion thereof and the inhalation air passage and the expiration air passage are defined at the respective sides of the carbon dioxide adsorption device. The inhalation air passage is communicated with the inhalation air bag and with the flexible inhalation tube connected to the mouthpiece unit. The expiration air passage is communicated with the expiration air bag and with the flexible expiration tube connected to the mouthpiece.

With this structure adopted, there is obtained such a benefit that the respiratory resistance can be reduced. Further, during a respiration action of the diver, the flow of expiration or inhalation air is weak at the beginning of the action but is strong at the middle part thereof. Where the layout of the present invention is adopted, at the beginning of an expiration action, an expired air is immediately stored in the expiration air bag without passing through the carbon dioxide adsorption device having a large flow resistance. Likewise, at the beginning of an inhalation action, a gas stored in the inhalation air bag is directly sucked out as a gas to be inhaled. Therefore, expiration and inhalation actions can be done relatively smoothly. Furthermore, with the layout of the present invention adopted, the expiration air bag can be arranged to connect vertically to the expiration tube communicated to the mouthpiece across the carbon dioxide adsorption device. Hence, there is obtained an advantage that moisture contained in an expiration gas is effectively stored in the bottom of the expiration air bag, which prevents an inhalation air from containing a large amount of moisture.

In the present invention, since the carbon dioxide adsorption device is made to be replaceable cartridge type, it can avoid such a skilled operation as the filling of an carbon dioxide adsorbent or the like. Further, where a carbon dioxide adsorbent is sealed in a bag and the bag is designed to be replaceable, the filling and replacing operations of the carbon dioxide adsorbent can be made more easily.

Further, according to the semiclosed respirator of the present invention, the gas supply in an emergency is carried out automatically in response to the change in pressure of the inhalation air passage, so that there is no need to operate manually to start the supplying of gas in an emergency as required conventionally, whereby the handling of the respirator becomes simplified. In addition, there is an advantage that the gas supply mechanism and the mechanism for discharging air from the respirator when it becomes full with gas can be provided with compact and simple structure.

Furthermore, the expiration air bag of the semiclosed respirator according to the present invention has an advantage that it is accommodated therein with the flexible water discharging air bag and, in response to a respiration action, is capable of discharging the water stored therein automatically. Where the air bag is of a double wall structure and is provided with the flexible members for restricting the deformation thereof, there can be obtained such advantages that a respiratory resistance during a respiration action can be reduced, the air bag do not rumbled to thereby improve its durability, and the like.

On the other hand, according to the semiclosed respirator of the present invention, by projecting the chewing pieces manually from the mouthpiece, holding the projected ends of pieces between the upper and lower teeth and maintaining this holding condition, a gas to be inhaled is allowed to supply from the gas bomb at a constant flow rate and at the same time the expiration tube can be maintained in an open condition. Therefore, the supplying of a gas to be inhaled can be started with simple operation, and when the mouthpiece is removed from the mouth of a diver during a course of diving, the chewing pieces return their initial positions, in response to which the expiration tube is automatically closed to prevent the water invasion in it.

Further, independent from a fresh gas to be inhaled supplied to the mouthpiece unit, the water-discharging gas supply pipe is arranged which supplies a gas at a larger flow rate to the mouthpiece from the gas bomb, and it is operated manually to carry out the water discharging operation. Hence, the discharging of water can be made easily without requiring any skilled operation.

Furthermore, according to the semiclosed respirator of the present invention, the safety jacket for mounting the respirator main body is provided with the air storing portions in which an inhalation air is supplied from the respiration gas bomb and stored, and thus, an inhalation air can be supplied from these portions in an emergency. Accordingly, a semiclosed respirator of high safety can be realized. In addition, an adjustment of buoyancy when surfacing can be made by controlling the amount of an inhalation air stored in the air storing portions, which is convenient.

We claim:

1. A semiclosed respirator wherein an expiration air recovered from a mouthpiece is regenerated through a carbon dioxide adsorption device, a regenerated gas and a fresh gas to be inhaled supplied at a constant flow rate from a respiration gas bomb are supplied to said mouthpiece as gasses to be inhaled, and an excess gas is discharged to the outside, comprising a driving gas supply pipe for inducing a gas from said respiration air bomb into said mouthpiece unit at a flow rate larger than that of said fresh gas to be inhaled, and a gas driven mechanism arranged in said mouthpiece unit which is constituted to be driven by a gas supplied through said drive gas supply pipe, wherein said driving gas supply pipe is disposed in an inhalation air tube connected between said mouthpiece unit and said carbon dioxide adsorption device.

2. A semiclosed respirator according to claim 1, wherein said driving gas supply pipe is a water-discharging gas supply pipe and said gas driven mechanism comprises a normally-closed valve positioned between said water-discharging gas supply pipe and said mouthpiece unit, a water-discharging manual operational member mounted on said mouthpiece unit for shifting said normally-closed valve to an open condition, and a water discharge valve which makes to communicate an inside of said mouthpiece unit to the outside only when a pressure in said mouthpiece unit exceeds a predetermined value.

3. A semiclosed respirator according to claim 2, wherein said mouthpiece comprises a respiration air communicating chamber which has an expiration-tube connecting portion communicated to said expiration tube through which an expiration air flows, an inhalation-tube connecting portion communicated to said inhalation tube through which an inhalation air flows, and an outer opening communicated to the outside, a gas supply port for supplying a fresh gas to be inhaled at a constant flow rate from said respiration gas bomb into said respiration air communicating chamber, a mouthpiece mounted on said outer opening, a check valve disposed in said expiration-tube connecting portion which permits a fluid flowing only from said respiration air communicating chamber into said respiration tube, a check valve disposed in said inhalation-tube connecting portion which permits a fluid flowing only from said inhalation tube into said respiration air communicating chamber, a valve means provided on said gas supply port, a pressing means for exerting an elastic force to maintain said valve means in a closed condition, a manually operational member capable of shifting said valve means into an open condition against said elastic force of said pressing means, and a chewing piece which, in response to said manually operational member, travels from a retracted position in said mouthpiece to an outwardly projected position.

4. A semiclosed respirator according to claim 3, further comprising a valve means provided in said expiration-tube connecting portion which is controlled to open and close in response to said valve means mounted on said gas supply port.

5. A semiclosed respirator wherein an expiration air recovered from a mouthpiece is regenerated through a carbon dioxide adsorption device, a regenerated gas and a fresh gas to be inhaled supplied at a constant flow rate from a respiration gas bomb are supplied to said mouthpiece as gasses to be inhaled, and an excess gas is discharged to the outside, comprising a hollow casing having an opening at its one side, a lid releasably attached to said opening, and a cartridge incorporating a carbon dioxide adsorbent is removably inserted into a sealed space defined by said casing and said lid;

wherein said carbon dioxide adsorption device has an adsorbent-filling tube having a cylindrical section which comprises air-permeable inner and outer sleeve arranged concentrically, sealing plates attached on respective sides thereof, and a partition plate for dividing a cylindrical adsorbent-filling portion into right and left sides at a middle position along an axial direction of said adsorbent-filling tube, and wherein one side of said divided cylindrical adsorbent-filling portions is communicated at its outer circumferential portion with said inhalation air passage, whereas the other side of said divided cylindrical adsorbent-filling portions is communicated at its outer circumferential portion with said expiration air passage.

6. A semiclosed respirator according to claim 5, wherein said carbon dioxide adsorption device has an adsorbent-filling tube having a cylindrical section and an adsorbent-sealed bag inserted into said adsorbent-filling tube, wherein said adsorbent-sealed bag is generally rectangularly shaped and is formed therein with a plurality of adsorbent-sealed portions defined by a plurality of seal portions extending in parallel at a predetermined interval, and wherein a carbon dioxide adsorbent is sealed in each of said adsorbent-sealed portions and said adsorbent-sealed bag is removably inserted into said adsorbent-filling tube in a cylindrically wound condition.

7. A semiclosed respirator wherein an expiration air recovered from a mouthpiece is regenerated through a carbon dioxide adsorption device, a regenerated gas and a fresh gas to be inhaled supplied at a constant flow rate from a respiration gas bomb are supplied to said mouthpiece as gasses to be inhaled, and an excess gas is discharged to the outside, comprising, a gas supply port for supplying a gas from said respiration gas bomb at a flow rate larger than that of said fresh gas to be inhaled, a gas discharge port for discharging an excess gas to the outside, and a control means for controlling opening end closing operation of said gas supply port and said gas discharge port, said elements being arranged in an inhalation air passage communicating to said mouthpiece, wherein said control means comprises a flexible pressure chamber which is communicated to said inhalation air passage and has a moving end wall for moving along first and second directions in response to a pressure in said inhalation air passage, said gas discharge port positioned in said moving end wall, a control rod which is pressed against said gas discharge port by an elastic force and is movable together with said moving end well with maintaining a condition that said gas discharge port is closed, an operational member which is operated by an end of said control rod when it is travelled beyond a predetermined distance toward said first direction, a normally-closed valve which opens said gas supply port in response to the travel of said operational rod, and an opening member which opens said gas discharge port of said moving end wall closed by said control rod against said elastic force when said control rod travels beyond a predetermined distance toward said second direction.

8. A semiclosed respirator wherein an expiration air recovered from a mouthpiece is regenerated through a carbon dioxide adsorption device, a regenerated gas and a fresh gas to be inhaled supplied at a constant flow rate from a respiration gas bomb are supplied to said mouthpiece as gases to be inhaled, and an excess gas is discharged to the outside, in which an expiration air bag has a flexible water discharge air bag assembled therein which is communicated with an inner side of said expiration air bag through a check valve for allowing a fluid to pass only into said water discharge air bag from said expiration air bag, and wherein said water discharge air bag is communicated to the outside through a check valve for allowing a fluid only to pass toward the outside therefrom, wherein at least one of said expiration and an inhalation air bags has a bag main body having a double wall structure comprised of flexible outer bag member and a flexible inner bag member, wherein said bag main body of double wall structure is provided with at least one flexible member arranged along a longitudinal direction of said bag main body, and wherein said flexible member is fixed at least at its both ends on said bag main body.

9. A semiclosed respirator wherein an expiration air recovered from a mouthpiece is regenerated through a carbon dioxide adsorption device, a regenerated gas and a fresh gas to be inhaled supplied at a constant flow rate from a respiration gas bomb are supplied to said mouthpiece as gases to be inhaled, and an excess gas is discharged to the outside, in which at least one of an expiration and an inhalation air bags has a bag main body having a double wall structure comprised of flexible outer bag member and a flexible inner bag member, wherein said bag main body of double wall structure is provided with at least one flexible member arranged along a longitudinal direction of said bag main body, and wherein said flexible member is fixed at least at its both ends on said bag main body.

10. A semiclosed respirator wherein an expiration air recovered from a mouthpiece is regenerated through a carbon dioxide adsorption device, a regenerated gas and a fresh gas to be inhaled supplied at a constant flow rate from a respiration gas bomb are supplied to said mouthpiece as gases to be inhaled, and an excess gas is discharged to the outside, in which said mouthpiece comprises a respiration air communicating chamber which has an expiration-tube connecting portion communicated to said expiration tube through which an expiration air flows, an inhalation-tube connecting portion communicated to said inhalation tube through which an inhalation air flows, and an outer opening communicated to the outside, a gas supply port for supplying a fresh gas to be inhaled at a constant flow rate from said respiration gas bomb into said respiration air communicating chamber, a mouthpiece mounted on said outer opening, a check valve disposed in said expiration-tube connecting portion which permits a fluid flowing only from said respiration air communicating chamber into said respiration tube, a check valve disposed in said inhalation-tube connecting portion which permits a fluid flowing only from said inhalation tube into said respiration air communicating chamber, a valve means provided on said as supply port, a press means for exerting an elastic force to maintain said valve means in a closed condition, a manually operational member capable of shifting said valve means into an open condition against said elastic force of said press means, and a chewing piece which, in response to said manually operational member, travels from a retracted position in said mouthpiece to an outwardly projected position.

11. A semiclosed respirator according to claim 10, further comprising a valve means provided in said expiration-tube connecting portion which is controlled to open and close in response to said valve means mounted on said gas supply port.

* * * * *